US008843033B2

(12) United States Patent
Yoneda et al.

(10) Patent No.: US 8,843,033 B2
(45) Date of Patent: Sep. 23, 2014

(54) DEVELOPER SUPPLIER, IMAGE FORMING APPARATUS, DEVELOPER SUPPLYING METHOD AND IMAGE FORMING METHOD

(75) Inventors: Takuzi Yoneda, Tokyo (JP); Mugijirou Uno, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 240 days.

(21) Appl. No.: 12/318,801

(22) Filed: Jan. 8, 2009

(65) Prior Publication Data

US 2009/0180813 A1 Jul. 16, 2009

(30) Foreign Application Priority Data

Jan. 10, 2008 (JP) ..... 2008-003709
Mar. 5, 2008 (JP) ..... 2008-054967
Sep. 8, 2008 (JP) ..... 2008-229189

(51) Int. Cl.
*G03G 15/08* (2006.01)
*G03G 15/01* (2006.01)

(52) U.S. Cl.
CPC .... *G03G 15/0126* (2013.01); *G03G 2215/0607* (2013.01); *G03G 15/0832* (2013.01); *G03G 15/0178* (2013.01)
USPC ..... 399/258; 399/223

(58) Field of Classification Search
CPC ..... G03G 2215/0607
USPC ..... 399/27, 223, 258, 259, 262
See application file for complete search history.

(56) References Cited

U.S. PATENT DOCUMENTS 4,565,435 A * 1/1986 Hart ..... 399/257
5,384,628 A 1/1995 Takami et al.
5,486,909 A 1/1996 Takenaka et al.
5,489,747 A 2/1996 Takenaka et al.
5,845,183 A 12/1998 Sugiyama et al.
5,915,155 A * 6/1999 Shoji et al. ..... 399/262
6,226,481 B1 5/2001 Yoneda et al.
6,855,469 B2 * 2/2005 Ikeda et al. ..... 399/262
7,233,756 B2 * 6/2007 Tamura ..... 399/258
7,277,649 B2 * 10/2007 Hirobe et al. ..... 399/27
7,349,653 B2 * 3/2008 Nishihama et al. ..... 399/223
7,627,272 B2 * 12/2009 Iwamura ..... 399/258 X
7,773,913 B2 * 8/2010 Ishida ..... 399/149
2005/0238391 A1 * 10/2005 Hibino ..... 399/267
2005/0281593 A1 12/2005 Ozeki et al.
2007/0116494 A1 5/2007 Uno et al.
2007/0280742 A1 12/2007 Matsumoto et al.

(Continued)

FOREIGN PATENT DOCUMENTS

JP 4-165822 6/1992
JP 2001-265088 9/2001

(Continued)

*Primary Examiner* — Sandra Brase
(74) *Attorney, Agent, or Firm* — Harness, Dickey & Pierce, P.L.C.

(57) ABSTRACT

A developer supplier for supplying a developer to each of a plurality of developing devices, includes a plurality of developer supplying units each configured to supply a developer in which a toner and a carrier are preliminarily dispersed at a given concentration to each of the plurality of developing devices. A proportion of the carrier included in the developer which is supplied to one of the plurality of developing devices is set so as to be greater than a proportion of the carrier included in the developer which is supplied to the another one of the plurality of developing devices.

27 Claims, 7 Drawing Sheets

(56) References Cited

U.S. PATENT DOCUMENTS

| | | | | |
|---|---|---|---|---|
| 2008/0063434 | A1 | 3/2008 | Uno et al. | |
| 2008/0175628 | A1 * | 7/2008 | Kita et al. | 399/262 |
| 2008/0181630 | A1 | 7/2008 | Matsumoto et al. | |
| 2008/0181670 | A1 | 7/2008 | Tsuda et al. | |
| 2008/0279592 | A1 | 11/2008 | Matsumoto et al. | |
| 2008/0310865 | A1 | 12/2008 | Uno et al. | |

FOREIGN PATENT DOCUMENTS

| | | |
|---|---|---|
| JP | 2004-029306 | 1/2004 |
| JP | 2004-126224 | 4/2004 |
| JP | 2004-280072 | 10/2004 |
| JP | 2005-316148 | 11/2005 |
| JP | 2007-133057 | 5/2007 |

* cited by examiner

DEVELOPER SUPPLIER, IMAGE FORMING APPARATUS, DEVELOPER SUPPLYING METHOD AND IMAGE FORMING METHOD

CROSS-REFERENCE TO THE RELATED APPLICATIONS

This application is based on, and claims the priority benefit of, each of Japanese Patent Application No. 2008-003709, filed on Jan. 10, 2008, Japanese Patent Application No. 2008-229189, filed on Sep. 8, 2008, and Japanese Patent Application No. 2008-054967, filed on Mar. 5, 2008, respectively, the descriptions of which are incorporated herein by reference in their entirety.

BACKGROUND OF THE INVENTION

1. Field of the Invention

The present invention relates to a developer supplier and an image forming apparatus, which employs a supplementary developer, in which a toner and a carrier are pre-mixed in a predetermined proportion, as a developer for a replenishment thereof, and which is compliant with a digital photography apparatus, such as a copier, a fax machine, or a printer, which employs a two-component developer. The present invention also relates to a developer supplying method and an image forming method.

2. Description of the Related Art

Conventionally, with regard to an image forming apparatus that employs a two-component developer, when performing a development operation across an extended period of time, a coating layer of a surface layer of a carrier experiences an abrasion, i.e., is worn away, and therefore white spots may occur within an solid image area. Another circumstance that may arise is that a toner material or an additive may adhere to the coating layer, causing a capability of the toner to become charged to decline gradually as a result, which may cause such as a smudge upon an image forming substrate for printing or imaging, or a toner scattering thereupon. When the developer deteriorates to such an extent as is described herein, it is typically replaced by a periodic visit to an end user thereof by a service personnel. In such a circumstance, the replacement of the developer is performed either upon only the developer, a developer unit including the developer, or an imaging unit including the developer unit.

In a typical market, there is no large variation in types of print source documents that are used by an end user who uses a full color image forming apparatus. In addition, such an end user may be in a circumstance wherein a demand for a printing in full color is appended to a pre-existing demand for a printing in black and white, while taking a consideration of cost and of a speed of such a printout. Consequently, it is more common to print a black and white image, rather than a full color image, with the full color image forming apparatus, and thus, a carrier for a black toner deteriorates more rapidly than a carrier for a color toner. Accordingly, replacements of a black developer are more increased in frequency than replacements of a color developer, which leads to an increase in a down time occurrence as a result of a developer replacement operation, as well as an increase in a running cost of the full color image forming apparatus.

On the other hand, the carrier and the toner are pre-mixed in a toner supplying device, and supplied from the toner supplying device to an developing device, while at the same time, the carrier which has deteriorated in the developing device is removed, to minimize the deterioration of the developer in the developing device and to reduce the frequency of the replacement of the developer (see, as an instance, Japanese Patent Application Publication No. 2004-029306 and Japanese Patent Application Publication No. 2007-133057). The above configuration allows performing the carrier of the developer in the developing device may be replaced while maintaining a volume of the developer in the developing device at a given amount. Such a system including pre-mixing the carrier and the toner in the toner supplying device where the mixture is stored is referred to as a "pre-mixed toner system".

Employing the pre-mixed toner system reduces a speed at which the carrier deteriorates, thus extending a period of an interval between the developer replacements. As a consequence, however, a configuration of the image forming apparatus is made more complex, while on the other hand, the image forming apparatus need not be significantly increased in a size thereof, the frequency of the replacement of the developer is reduced, and it is possible to achieve a shortening of a time for an operation of the replacement of the developer, as well as to control an increase in the running cost of the full color image forming apparatus.

In a circumstance where the pre-mixed toner system is adopted, the system is naturally adopted for the developer for every color (see, as an instance, Japanese Patent Application Publication No. 2004-029306). In such an image forming apparatus, it is preferable to perform a replacement of the developer for every color at one time, in order to control the increase in the down time that arises from the operation of the replacement of the developer, as well as the increase in the running cost. When adopting the conventional pre-mixed toner system, however, the interval for the replacement of the developer varies for each color, and thus, it has not been preferable to perform the operation of the replacement of the developer all at one time because, if every color is thus replaced all at one time, the developer not reaching its end of life is replaced as well as the developer that reaching its end of life.

Thus, a technology in which volume of the black developer is made larger than volume of the color developer has been developed and commercialized. Simply increasing the volume of the developer, however, causes such a problem as being unable to use a common toner cartridge to hold both the black toner and the color toner, as well as a problem of causing an increase in a size of the toner cartridge for the black toner larger, as well as potentially causing a further increase in a size of the image forming apparatus itself, as a result.

As a technology that is capable of minimizing the increase in the size of the image forming apparatus, there is known a technology in which a thickness of a film of the black developer on a development roller is made greater than a thickness of a film of the color developer. In such a circumstance, however, since a physical property of the carrier is changed in order to achieve a standardization of the developing device, an impact upon an image quality may potentially occur, i.e., the image quality may decline as a result.

SUMMARY OF THE INVENTION

An object of the present invention is to provide a developer supplier or an image forming apparatus a) that extends a lifetime of an developing device containing a developer including a black toner, which is a color that has a high frequency of usage; b) shortens a time for an operation of a replacement of the developer; and c) controls an increase in a running cost.

Another object of the present invention is to provide a developer supplier or an image forming apparatus that is capable of adequately controlling an increase in a down time that arises from the operation of the replacement of the developer, as well as the increase in the running cost, while employing a common carrier across the developer for every color, and making a volume of the developer for each respective color identical thereto.

In order to achieve the above objects, a developer supplier according to an embodiment of the present invention is used for supplying a developer to each of a plurality of developing devices and includes a plurality of developer supplying units each configured to supply a developer in which a toner and a carrier are preliminarily dispersed at a given concentration to each of the plurality of developing devices. A proportion of the carrier included in the developer which is supplied to one of the plurality of developing devices is set so as to be greater than a proportion of the carrier included in the developer which is supplied to the another one of the plurality of developing devices.

BRIEF DESCRIPTION OF THE DRAWINGS

FIG. 7 is a schematic diagram that depicts a shape of a toner that is employed in an embodiment of the image forming apparatus according to the present invention.

DETAILED DESCRIPTION OF THE PREFERRED EMBODIMENTS

Preferred embodiments of the present invention will be explained in detail hereinafter, with reference to the accompanying drawings.

A developer supplier according to an embodiment of the present invention, which is used for supplying a developer to each of a plurality of developing devices, includes a plurality of developer supplying units each configured to supply a developer in which a toner and a carrier are preliminarily dispersed at a given concentration to each of the plurality of developing devices. A proportion of the carrier included in the developer which is supplied to one of the plurality of developing devices is set so as to be greater than a proportion of the carrier included in the developer which is supplied to the another one of the plurality of developing devices.

Figure 1:
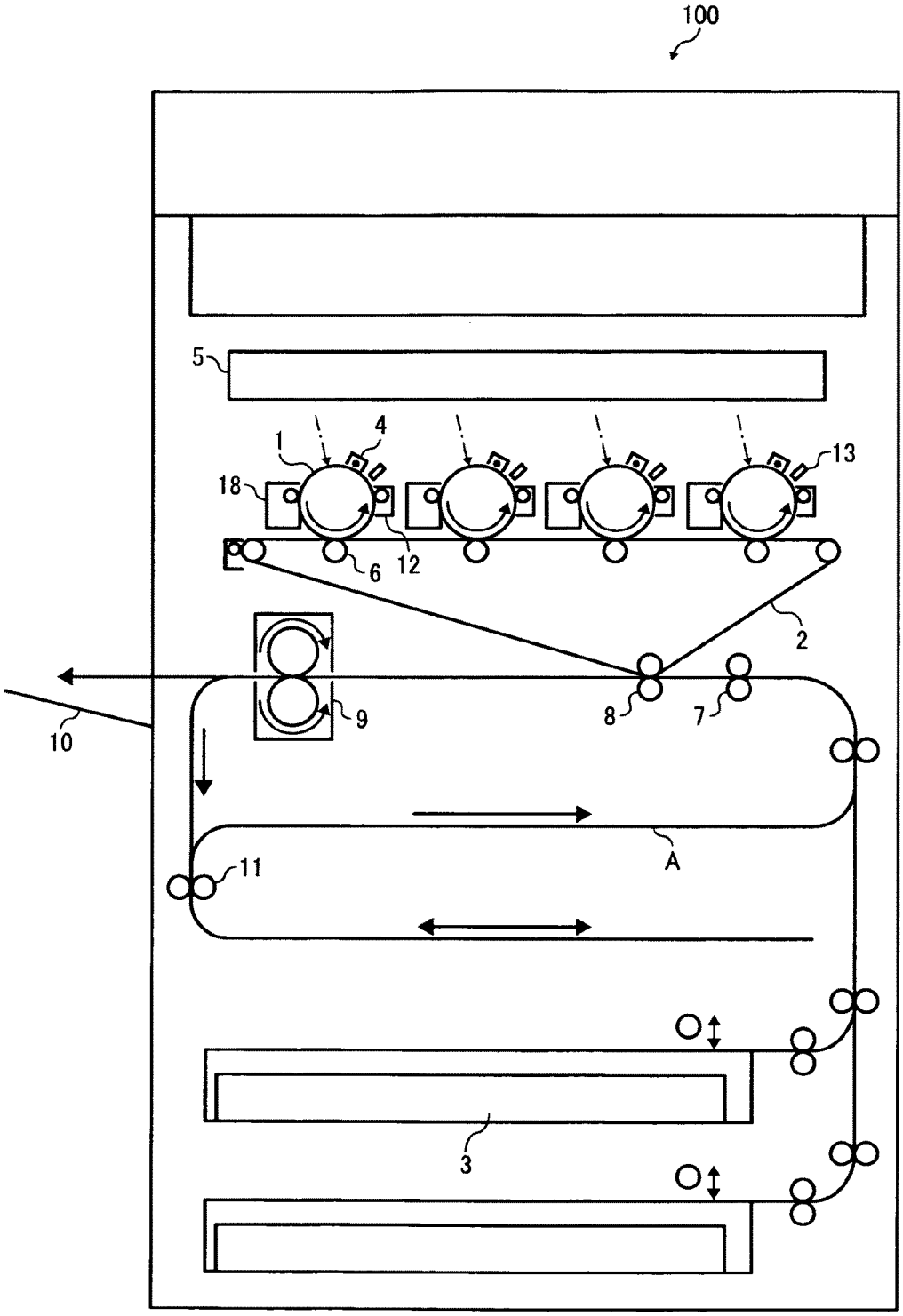
FIG. 1 is a view illustrating an image forming apparatus according to a first embodiment of the present invention.

FIG. 1 depicts an image forming apparatus 100 using the developer supplier P according to an embodiment of the present invention. The image forming apparatus 100 includes a plurality of image carriers 1 on each of which an electrostatic latent image is formed, a plurality of developing devices 18 each configured to develop the electrostatic latent image formed on each of the plurality of image carriers 1 with the developer to form a toner image, the plurality of developing devices 18 including a black developing device configured to employ a black toner and a color developing device configured to employ a color toner of a color other than black. A proportion of the carrier included in the developer which is supplied to the black developing device is set so as to be greater than a proportion of the carrier included in the developer which is supplied to the color developing device.

As an instance thereof, a dry format two-component development system as a development system of an image forming apparatus 100 is implemented upon a full color copying machine where a quadruple tandem intermediate transfer system is adopted. In this embodiment, such a copying machine is described as a representative instance of the image forming apparatus 100, however, and the image forming apparatus 100 is not limited to such as the configuration or the system described herein, provided that the dry format two-component development system is adopted.

A developer supplying method according to an embodiment of the present invention for supplying a developer to each of a plurality of developing devices 18, includes supplying a developer in which a toner and a carrier are preliminarily dispersed at a given concentration to each of the plurality of developing devices such that a proportion of the carrier included in the developer which is supplied to one of the plurality of developing devices 18 is set so as to be greater than a proportion of the carrier included in the developer which is supplied to the another one of the plurality of developing devices.

An image forming method according to an embodiment of the present invention, includes charging each of a plurality of image carriers to form an electrostatic latent image, supplying a developer in which a toner and a carrier are preliminarily dispersed at a given concentration to each of a plurality of developing devices 18, developing the electrostatic latent image formed on each of the plurality of image carriers 1 with the developer to form a toner image, wherein a proportion of the carrier included in the developer which is supplied to one of the plurality of developing devices 18 is set so as to be greater than a proportion of the carrier included in the developer which is supplied to the another one of the plurality of developing devices 18.

In the image forming method, the one of the plurality of developing devices may be a black developing device 18 configured to employ a black toner and the another one of the plurality of developing devices 18 is a color developing device configured to employ a color toner of a color other than black.

An image forming operation will be described in detail as follows. When an instruction to commence a print job is inputted to the image forming apparatus 100, each of a photoconductor 1 as the image carrier, an intermediate transfer belt 2, and some rollers which are provided on a paper feeding path starts to rotate, and a recording paper starts to be fed from a paper feed tray 3 located in a lower portion of the image forming apparatus 100. A surface of the photoconductor 1 is uniformly charged at an electric potential by an electric charger 4, and the surface of the photoconductor is exposed with a writing light projected from a write unit 5 as an exposure unit. A pattern of the electric potential after the exposure is referred to as an electrostatic latent image, and the electrostatic latent image which is supported on the surface of the photoconductor 1 is developed into a specified color by way of a toner supplied from one of the plurality of developing devices of the dry format two-component development system.

As shown in FIG. 1, in this embodiment, the four photoconductors 1 are provided for four color components, and thus, a toner image in each color of yellow, magenta, cyan, and black (the color sequence may vary depending on a system) is developed upon each respective photoconductor 1. The toner image that is developed upon the photoconductor 1 is transferred to the intermediate transfer belt 2 at a contact point between the photoconductor 1 and the intermediate transfer belt 2, by way of a transfer bias impressed upon a primary transfer roller 6 installed opposite to the photoconductor 1, as well as a pressure applied upon the intermediate transfer belt 2 from the primary transfer roller 6. A full color toner image is formed by transferring the toner image for each of the four colors to the intermediate transfer belt 2 in sequence while matching a timing of transferring.

The full color toner image formed upon the intermediate transfer belt 2 is transferred to the recording paper conveyed with resist rollers 7 after a timing of the paper feeding has been matched or adjusted. In such a circumstance, a transfer of the full color toner image is performed by a secondary bias impressed upon secondary transfer rollers 8, as well as a pressure applied by the secondary transfer roller 8. The recording paper on which the full color toner image is transferred is passed through a fixing unit 9, and thereby the toner image supported upon the surface of the recording paper is heated and fixed.

If a single sided print is being performed on the recording paper, the recording paper is directly conveyed thereafter to be outputted to an output tray 10. If a double sided print is being performed on the recording paper, on the other hand, a direction of a conveyance of the recording paper is changed to a downward direction, and the recording paper is conveyed to a paper reversing unit. Upon reaching the paper reversing unit, the direction of the conveyance of the recording paper is inverted by switchback rollers 11, and exits the paper reversing unit from a trailing edge of the recording paper. A front surface or a back surface of the recording paper is thus inverted by the above-described operation. The recording paper after the front surface or the back surface thereof is inverted does not return to the fixing unit 9 but passes through a paper re-feeding path A and then joins with the paper feeding path. Thereafter, the toner image is transferred upon the recording paper in a manner identical to the printing upon the front surface thereof, whereupon the recording paper passes through the fixing unit 9 and is outputted thereafter. The operation thus described is a double sided print operation.

Upon passing through the primary transfer roller 6, the surface of the photoconductor 1 supports the toner that remains thereon after the primary transfer, and, as a consequence thereof, the primary transfer remaining toner is thus removed by a photoconductor cleaning unit 12. Thereafter, the electric charge on the surface of the photoconductor 1 is uniformly removed by a quenching lamp 13, to prepare the surface for being charged for a successive image. In addition, the surface of the intermediate transfer belt 2 also supports the toner that remains thereon after passing through the secondary transfer portion, and the secondary transfer remaining toner on the intermediate transfer belt 2 is removed by an intermediate transfer belt cleaning unit so that the intermediate transfer belt 2 is prepared for a successive transfer of a toner image.

Either the single sided printing or the double sided printing is performed by repeating the above-described operation.

Figure 2:
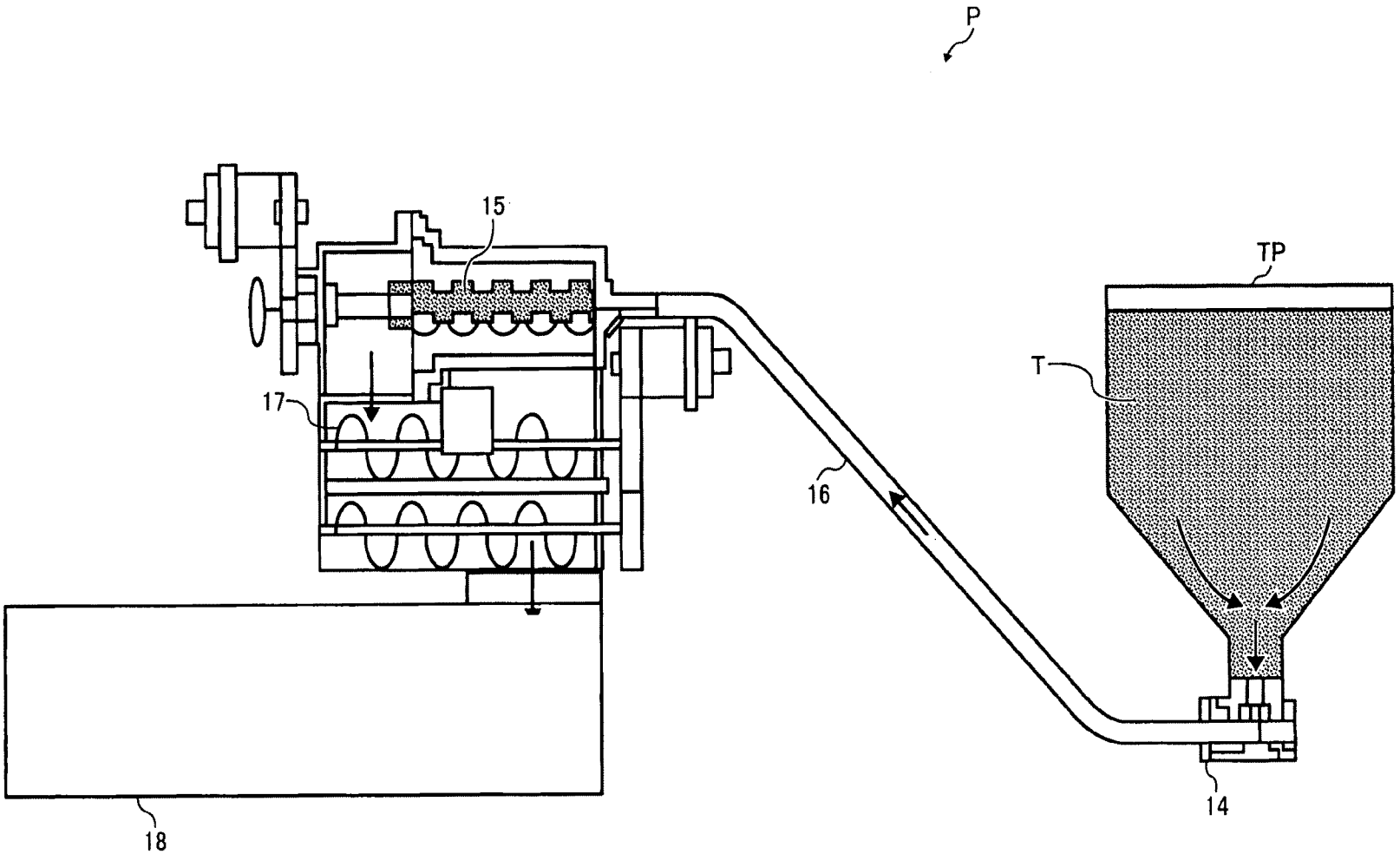
FIG. 2 is a view illustrating a pre-mixed toner supplying device.

A supplementary developer supplying device which is configured to supply a supplementary developer with a reduced-capacity toner supplementation system will be described below. The supplementary developer includes a toner and a carrier, which have preliminarily been dispersed at a given concentration and is referred to as "pre-mixed toner". The supplementary developer supplying device is referred to as "pre-mixed toner supplying device". As shown in FIG. 2, the pre-mixed toner supplying device P includes a developer supplying container TP having a holding capacity, which is capable of being reduced because the developer supplying container TP is made of a flexible material and is capable of being folded. The supplying container TP is filled with a pre-mixed toner T as the supplementary developer in which a toner and a carrier have preliminarily been dispersed at a given concentration.

A toner discharge port connected to a nozzle 14 is provided at a lowermost portion of the supplying container TP, and the pre-mixed toner T with which the supplying container TP is filled flows downward by gravity, and thereby gathers in the toner discharge port. A powder pump of a suction type 15 is driven in response to a toner supplementation instruction. The pre-mixed toner T is sucked into the powder pump 15 through a tube 16 connecting between the nozzle 14 and the powder pump of the suction type 15, by driving of the powder pump 15. A sub hopper 17 is provided upon a lower portion of the powder pump 15 and the toner is supplied to the developing device 18 by way of a conveying screw of the sub hopper 17. It is to be understood that a configuration in which the toner is directly supplied from the powder pump 15 to the developing device 18 without the sub hopper 17 being provided would also be permissible. When a required quantity of the pre-mixed toner T is supplied to the developing device 18, the driving of the powder pump 15 is stopped, and the supplementation of the toner is no longer performed.

An advantage of the reduced capacity system lies in that, the pre-mixed toner T uniformly mixed prior to the filling of the supplying container TP is supplementarily supplied to the developing device while the toner and the carrier being still uniformly dispersed therein because no agitation operation of the toner takes places in a toner cartridge. The supplying container TP deforms and contracts as the pre-mixed toner T is discharged therefrom.

In the reduced capacity toner supplementation system, the pre-mixed toner T is discharged from the supplying container TP while an air is gradually discharged into a space of an upper level portion of the supplying container TP. When a percentage of the space of the supplying container, which is defined as a volume of the air divided by the capacity of the container, is 0%, the pre-mixed toner T is packed therein such as by way of a vacuum packing process and, as a consequence thereof, the toner is rendered completely immobile within the toner cartridge. When the percentage of the space is greater than or equal to 12%, it is possible for the pre-mixed toner T to be steadily discharged from the supplying container TP until the toner is completely used up. Thus, the percentage of the space in the supplying container TP before the supplying container TP in which the pre-mixed toner is stored is used, is made to be greater than 0% and less than 12%.

In addition, it is preferable that the amount of the carrier in the pre-mixed toner T be treated as 3 wt % or greater. A reason thereof is that, if a percentage of the carrier in the mixture is low, a percentage of the toner in the mixture will increase, thereby making it easier for the pre-mixed toner T to rush into a close proximity to an outflow port in the toner cartridge. In addition, since the added carrier serves as a lubricant, when the percentage of the carrier in the mixture is high, it is possible for the pre-mixed toner T that has thus rushed to flow smoothly, thereby facilitating the toner being supplied with a smaller volume of space than would otherwise be necessary. Accordingly, it is thereby possible for the toner cartridge to facilitate the steady supply of the toner in a state where the capacity of the toner cartridge is reduced. Conversely, if the amount of the carrier exceeds 30 wt %, a fluidity of the toner will decline, and, as a consequence thereof, the toner cartridge will become incapable of steadily supplying the pre-mixed toner T. Given such a condition, it is preferable for the amount of the carrier in the pre-mixed toner to be treated as between 3 wt % and 30 wt %.

Figure 3:
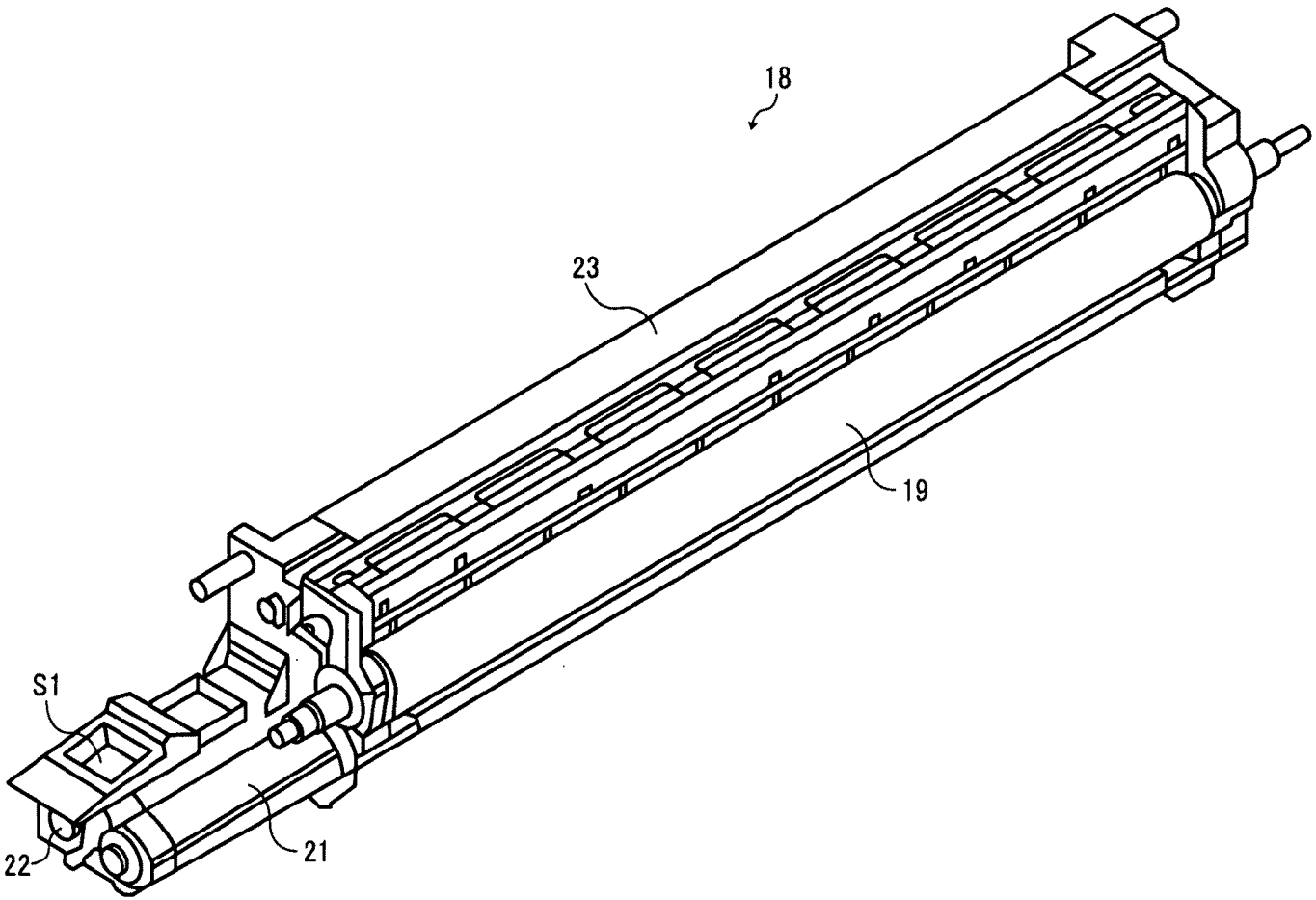
FIG. 3 is a perspective view illustrating an external view of a developing device.
Figure 4:
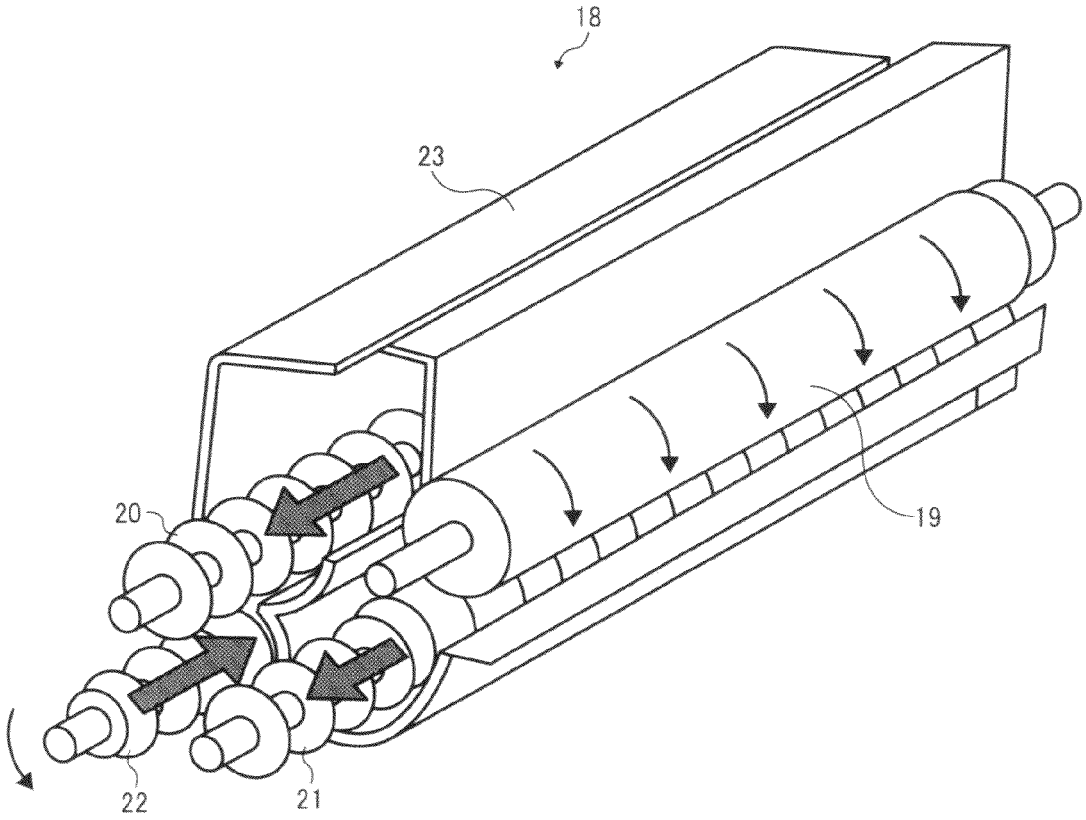
FIG. 4 is a perspective view illustrating an internal structure of a developing device.
Figure 5:
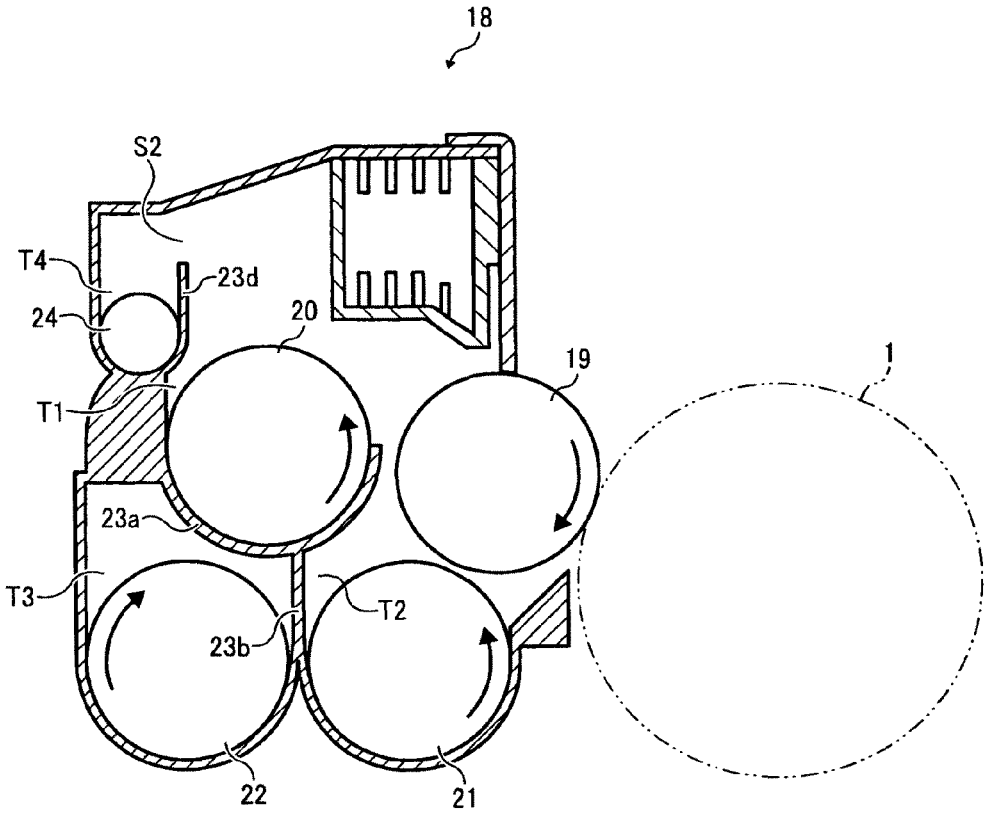
FIG. 5 is a view illustrating an internal structure of a developing device.

The developing device to which the pre-mixed toner is supplied will be described with reference to FIGS. 3 to 5. It is to be understood that a portion of an internal structure depicted in FIG. 5 is omitted in a depiction of an internal structure denoted in FIG. 4. In the developing device 18 that is depicted in each of FIGS. 3 to 5, a development roller 19 rotates in a clockwise direction in FIGS. 3 to 5, and thereby supplies the pre-mixed toner to the latent image formed on the surface of the photoconductor 1. In addition, a supplying screw 20 is provided in the development device 18 to convey the pre-mixed toner in a direction of a paper thickness while supplying the pre-mixed toner to the development roller 19 and a supplying conveyance path T1 is formed. The supplying screw 20 has a rotational shaft and blade portions provided on the rotational shaft.

A developer doctor is provided on a downstream side of the development roller 19 from a portion facing the supplying screw 20 in a direction of a movement of the surface of the development roller 19 to regulate a thickness of the pre-mixed toner supplied to the development roller 19 so as to be suited for the developing of the image thereby.

A recovery screw 21 is provided on a downstream side of the development roller 19 from a development portion facing the photoconductor 1 in the direction of the movement of the surface of the development roller 19 to recover the used developer after passing through the development portion and convey the recovered developer in a direction identical to the conveying direction of the supplying screw 20. The supplying conveyance path T1 on which the supplying screw 20 is provided is provided at a side of the development roller 19 and in a parallel manner thereto, and a recovery conveyance path T2 on which the recovery screw 21 is provided is provided beneath the development roller 19 and in the parallel manner thereto.

An agitation conveyance path T3 is provided beneath the supplying conveyance path T1 in the developing device 18 and in a parallel manner with the recovery conveyance path T2. An agitation screw 22, which conveys the developer by rotating in a direction opposite to the rotational direction of the supply screw 20, is provided in the agitation conveyance path T3.

The supplying conveyance path T1 is separated from the agitation conveyance path T3 by a partition 23*a* which is formed by the developing device and is in a longitudinal arc shape in section. An opening is formed upon both of end portions of the partition 23*a* in a lengthwise direction to communicate between the supply conveyance path T1 and the agitation conveyance path T3.

The supplying conveyance path T1 is also similarly separated from the recovery conveyance path T2 by the partition 23*a*, it is to be understood that an opening is not formed on a portion of the partition 23*a*, which separates the supplying conveyance path T1 from the recovery conveyance path T2.

The recovery conveyance path T2 is separated from the agitation conveyance path T3 by a partition 23*b*. An opening is formed upon one of an end portion of the partition 23*b* in a lengthwise direction thereof to communicate between the recovery conveyance path T2 and the agitation conveyance path T3.

The supplying screw 20, the recovery screw 21, and the agitation screw 22 are formed from either a plastic or a metal material. A diameter of each respective screw is, for example, substantially 22 mm. In addition, a pitch of screw is, for example, substantially two 50 mm turns for the supplying screw 20, and one 25 mm turn for each of the recovery screw 21 and the agitation screw 22, respectively. A rate of rotation when the developing device 18 is in the operation is set to, for example, approximately 600 rpm.

The developer formed in a thin layer form on the development roller 19 by the stainless steel developer doctor is conveyed to a development area which is an opposite portion to the photoconductor 1 where the developing is performed. The surface of the development roller 19 is either formed into a V-shaped pit or processed by sandblasting, is, for example, formed from a tube of either pure aluminum or pure stainless steel with a diameter of 25 mm, and a gap between the developer doctor and the photoconductor 1 is, for example, about 0.3 mm. The developer doctor is formed from a material being, for example, both rigid and magnetic, more particularly, may be formed from a metal material such as iron or stainless steel for the purpose. It is also possible to employ a resin material in which magnetic particles, such as ferrite or magnetite particles, are combined. Furthermore, it is also permissible for a separate member, such as a metal plate formed from a magnetic material, to be anchored to the developer doctor, either directly or indirectly, rather than for the developer doctor to be formed of the magnetic material.

The used developer is recovered and conveyed by the recovery conveyance path T2, and is transferred to the agitation conveyance path T3 at the opening of the partition 23*b*, which is provided in a non-image region portion. It is to be understood that a developer supplementation port S1 is formed in a close vicinity of the opening of the partition 23*a* at an upstream part in the direction of the developer conveyance, in the agitation conveyance path T3. The developer is supplementally supplied via the developer supplementation port S1 to the agitation conveyance path T3.

A replacement of the developer in the developing device will be explained. The supplementary developer, i.e., the pre-mixed toner, is supplied to the developing device 18 via the developer supplementation port S1. A developer discharge port S2 is provided on the supplying conveyance path T1 to discharge a portion of the developer to an outside of the developing device 18 when the developer in the supplying conveyance path exceeds a prescribed quantity. The developer discharged from the developer discharge port S2 is sent to a discharge conveyance path T4, which has an output conveyance screw 24, and is discharged to the outside of the developing device 18 by way of the discharge conveyance path T4. The discharge conveyance path T4 is provided so as be adjacent to the supplying conveyance path T1, separated therefrom by a partition 23*d*, and located on a downstream part of the supplying conveyance path T1 in the direction of the conveyance of the supplying conveyance path T1.

The developer discharge port S2 is an opening provided on the partition so as to communicate between the supplying conveyance path T1 and the discharge conveyance path T4. If the developer in the developing device reaches a given quantity without interruption, the developer therewithin is discharged to the outside of the developing device by way of the developer discharge port S2. As a consequence, the amount of the supplemental pre-mixed toner which is newly supplied from the developer supplementation port S1 is maintained at an amount that is identical to the amount of the developer that is discharged from the developer discharge port. Thus, a deterioration of the carrier is kept under control by constantly automatically replacing a portion of the carrier and it is possible to obtain a stable function of the developer over an extended period of time, without having to perform a replacement of the developer.

The developing device 18 is provided in each of four units each for yellow, magenta, cyan, and black, respectively, as is shown in FIG. 1. Thus, according to an embodiment of the present invention, the proportion of the carrier contained in the pre-mixed toner in which the black toner is employed is greater than the proportion of the carrier contained in the pre-mixed toner in which the color toner is employed.

As an example of the deterioration of the carrier, the electrical resistance of the carrier declines due to scrapping of the carrier as the carrier is used over time. As the electrical resistance of the carrier is reduced, the carrier separates easily from the development roller and adheres easily to an electrostatic latent image portion of the photoconductor and therefore a carrier deposition or adhesion occurs so that white spots may occur within a solid image portion. Accordingly, as a method of assessing a degree of the deterioration of the carrier, a transition in the scrapping or abrasion of the carrier is estimated based on a transition of a static resistance of the carrier over an operating time of the developing device.

The scrapping or abrasion of the carrier takes place over time, and is dependent upon number of copies. Thus, the proportion of the carrier contained in the black pre-mixed toner is greater than the proportion of the carrier contained in the color pre-mixed toner. It is thus possible to delay an onset of the deterioration of the carrier employed in the black toner, which has a high frequency of use and deteriorates rapidly in a conventional device, by making the amount of the carrier employed in the black toner greater than the amount of the carrier employed in the color toner. It is thus possible to narrow a gap of a time interval of a replacement of the carrier employed in each respective color. As a consequence, it is possible to extend an interval between a given operation to replace the developer and another given operation thereof. Accordingly, it is possible to exercise an adequate degree of control over an increase in an occurrence of a down time arising from the operation to replace the developer, as well as an increase of a running cost of the image forming apparatus as a result. Although it is not shown in FIG. 2, it may be permissible that the carrier and the toner are placed in a separate supplying container TP, and the carrier is mixed with the toner in each respective color developer immediately prior to the supply thereof to determine a pre-mix proportion thereof.

In addition, a frequency of usage varies for each respective color of the color toner, and thus, a differential occurs to one degree or another in the interval of the replacement therebetween. It is thus possible to bring the interval of the replacement of each respective color into a alignment by making the proportion of the carrier correspond to each respective color.

Furthermore, the carrier included in the developer of the black developing device may be identical to the carrier included in the developer of the color developing device. That is, the carrier contained in the supplementary developer employed in the black toner may be made to be the same as the carrier contained in the supplementary developer employed in the color toner of the color other than the black toner. For example, if the scrapping or the abrasion of the carrier is controlled by adjusting the film thickness of the carrier, the film thickness of the carrier varies on a per color basis, including the black. This declines an efficiency of a production of the carrier, and an expense is incurred out of necessity as well in order to maintain and manage the carrier. Accordingly, it is possible to increase a productivity of such as a manufacturing of the carrier by standardizing the carrier, including a grain diameter, a film thickness, a base material, and a film material.

In addition, the supplying container TP of the pre-mixed toner supplying device P is filled with the pre-mixed toner containing the carrier and the toner. The supplying container TP is connected to the nozzle 14, as shown in FIG. 2, and is capable of being replaced. It is possible thereby to supplementally supply the pre-mixed toner by using the supplying container TP while replacing the supplying container TP until the developer within the developing device 18 reaches an end of a useful life thereof. In such a circumstance, it may be permissible to set the carrier contained in the supplemental developer in which the black toner that is stored in the supplying container TP is employed, and the carrier contained in the supplemental developer in which the toner of the color other than the black that is stored in the supplying container TP is employed, to a given mixture proportion, i.e., a pre-mixed proportion. It is possible to easily store and manage the developer mixture as a result.

It is to be understood that the toner is not limited in any particular manner according to the embodiment, provided that the toner is an established, known toner. Whereas the toner according to the embodiment includes a binder resin as well as a coloring agent, it may be permissible for the toner to include a release agent, i.e., an "oilless" toner. An oilless toner is capable of being employed even in a fixing system in which a fixing roll is not coated with an oil for preventing the toner from adhering thereto. Whereas a so-called spent phenomenon, in which the release agent shifts upon the surface of the carrier, may typically occur frequently with the oilless toner, the supply of the carrier is performed in unison with the supply of the toner in the pre-mixed system, resulting thereby in a significantly improved resistance to the spent phenomenon over a conventional system of supplementally supplying only the toner, and thus allowing preserving a good quality over an extended period of time.

A polymerized toner is employed to provide a toner with a reduced grain diameter and a spherical shape thereof, in order to implement a high definition color image in particular according to the embodiment. The polymerized toner according to this embodiment will be explained.

An average grain diameter by volume of the toner in a range between 3 μm and 8 μm is preferable in order to reproduce a dot at a resolution of 600 dpi or greater. It is also preferable for a ratio (Dv/Dn) of the average grain diameter by volume (Dv) to an average grain diameter by a quantity of grains (Dn) to fall within a range of between 1.00 and 1.40. The closer the ratio Dv/Dn is to 1.00, the sharper a distribution of the grain diameter becomes. In the toner with such a small grain diameter and such a narrow distribution of the grain diameter, a distribution of a coulometry of the electrical charge of the toner is made uniform, and it is possible thereby to obtain a high quality image with little fogging of an image forming substrate for printing or imaging thereof. In addition, it is also possible to increase a rate of transfer in an electrostatic transfer system.

As a device for measuring a gain size distribution of the toner grain according to a Coulter Counter Method, it may be possible to cite a Coulter Counter TA-II or a Coulter Multisizer II (both manufactured by Beckman Coulter, Inc.). The measuring method thereof will be explained.

To begin with, a surfactant (preferably alkylbenzene sulfonate) of between 0.1 ml and 5 ml is added as a dispersing agent to a solution of electrolyzed water of 100 to 150 ml. In the present circumstance, the solution of electrolyzed water refers to a solution of approximately 1% sodium chloride (NaCl), being a primary sodium chloride, and it may be possible to use an ISOTON-II (manufactured by Beckman Coulter, Inc.) for such a purpose, as an instance thereof. A measurement sample of between 2 and 20 mg is added thereto. A dispersion process of the solution of electrolyzed water in which the measurement sample is suspended is performed for approximately one to three minutes using an ultrasound dispersion module, and volume of the toiler or the toner grain, and a number of the toner gain are measured by the measuring device, which employs a 100 μm aperture, so that the distribution of the volume and the number of the toner is computed therefrom. It is possible to derive an average grain diameter of the toner by weight (D4), as well as the average grain diameter by number, from the distribution obtained by the measurement.

A grain of a size ranging of 2.00 μm or more and less than 40.30 μm is targeted and as 13 channels of 2.00 μm or more and less than 2.52 μm; 2.52 μm or more and less than 3.17 μm; 3.17 μm or more and less than 4.00 μm; 4.00 μm or more and less than 5.04 μm; 5.04 μm or more and less than 6.35 μm; 6.35 μm or more and less than 8.00 μm; 8.00 μm or more and less than 10.08 μm; 10.08 μm or more and less than 12.70 μm; 12.70 μm or more and less than 16.00 μm; 16.00 μm or more and less than 20.20 μm; 20.20 μm or more and less than 25.40 μm; 25.40 μm or more and less than 32.00 μm; and 32.00 μm or more and less than 40.30 μm, respectively.

Figure 6A:
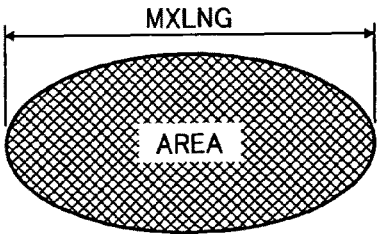
FIG. 6A is a schematic view illustrating a shape of a toner to explain a shape factor SF-1.

It is preferable for a shape factor SF-1 of the toner to be within a range between 100 and 180, and for a shape factor SF-2 of the toner to be within a range between 100 and 180 as well. FIG. 6 is a schematic view illustrating a shape of the toner in order to describe the shape factor SF-1 and the shape factor SF-2 thereof. The SF-1 denotes a degree of a roundness of the shape of the toner, shown in FIG. 6A, and is represented by an equation (1), which is described hereinafter, such that a square of a maximum length MXLNG of a shape that is capable of being formed by the toner in a two-dimensional plane is divided by an area of an image formation AREA, and a dividend thereof is multiplied in turn by 100 times π/4 to derive a value of the SF-1 thereof:

$$SF\text{-}1=\{(MXLNG)^2/AREA\}\times(100\pi/4) \quad (1)$$

A shape of the toner forms a perfect spherical shape when the value of the SF-1 thus derived is 100, and thus, the shape of the toner becomes increasingly irregular the greater the value of the SF-1 becomes.

Figure 6B:
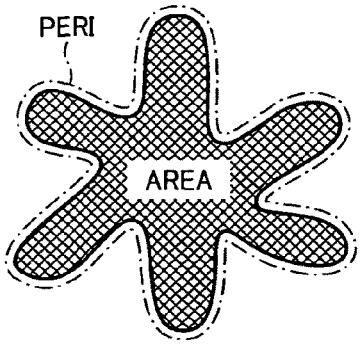
FIG. 6B is a schematic view illustrating a shape of a toner to explain a shape factor SF-2.

In addition, the shape factor SF-2 denotes a degree of jaggedness of the shape of the toner, as shown in FIG. 6B, and is represented by the following equation (2), such that a square of a perimeter PERI of the shape that is capable of being formed by the toner in the two-dimensional plane is divided by the area of the image formation AREA, and the dividend thereof is multiplied in turn by 100 times π/4 to derive a value of the SF-2 thereof:

$$SF\text{-}2=\{(PERI)^2/AREA\}\times(100\pi/4) \quad (2)$$

A surface of the toner incurs no jaggedness when the value of the SF-2 thus derived is 100, and thus, the jaggedness of the surface of the toner becomes increasingly prominent the greater the value of the SF-2 becomes.

More specifically, the measurement of the shape factor involves capturing an image of the toner with a scanning electron microscope, i.e., an S-800, manufactured by Hitachi, Ltd., which is loaded into an image analysis device, i.e., a LUSEX 3, manufactured by Nireco Corporation, and analyzed and calculated for 100 toner grains.

As the shape of the toner approaches the spherical shape, either an adhesion among the toner weakens and a fluidity thereof increases accordingly, or an adhesion between the toner and the photoconductor also decreases and the rate of transfer therebetween increases, in order that a contact state between the toner and the photoconductor forms a point contact thereupon. It is not preferable for the value of either the shape factor SF-1 or the shape factor SF-2 to exceed 180, as the rate of transfer declines as a result thereof.

The toner that is suitable to be employed in the image forming apparatus 100 according to the embodiment is a toner which is obtained such that, at a minimum, a polyester pre-polymer including a functional group containing a nitrogen atom, a polyester, the coloring agent, the release agent, and a toner material solution are dispersed in an organic solvent to obtain a toner material solution and cross-linking reaction and/or elongation reaction of the toner material solution in an aqueous solution are performed. Both a configuration material and a production method of the toner will be explained.

(Polyester)

A polyester is obtained by way of a polycondensation reaction between a polyvalent alcohol compound and a polyvalent carboxylic acid compound.

As the polyvalent alcohol compound (PO), it would be possible to apply a divalent alcohol (DIO), or a polyvalent alcohol (TO) having three or more hydroxyl groups, and either entirely the divalent alcohol compound or a compound of the divalent alcohol (DIO) mixed with a small quantity of the polyvalent alcohol (TO) would be preferable. As the divalent alcohol (DIO), it would be possible to cite an alkylene glycol, i.e., such as ethylene glycol, 1,2-propylene glycol, 1,3-propylene glycol, 1,4-butanediol, or 1,6-hexanediol; an alkylene ether glycol, i.e., such as diethylene glycol, triethylene glycol, dipropylene glycol, polyethylene glycol, polypropylene glycol, or polytetramethylene ether glycol; an alicyclic diol, i.e., such as 1,4-cyclohexanedimethanol or hydrogenated bisphenol A; a bisphenol, i.e., such as bisphenol A, bisphenol F, or bisphenol S; an alkylene oxide adduct of the above-described alicyclic diol with an alkylene oxide, i.e., such as ethylene oxide, propylene oxide, or butylene oxide; or an alkylene oxide adduct of the above-described bisphenol with an alkylene oxide, i.e., such as ethylene oxide, propylene oxide, or butylene oxide. Among the compounds listed herein, the preferable compound would be a $C_{2-12}$ alkylene glycol and the alkylene oxide adduct of the bisphenol, more particularly, the alkylene oxide adduct of the bisphenol and a mixture thereof with the $C_{2-12}$ alkylene glycol. As the polyvalent alcohol (TO) with three or more hydroxyl groups, it would be possible to cite, for example, a polyvalent aliphatic alcohol with either between a trivalence and an octavalence or of a greater polyvalence, i.e., such as glycerine, trimethylolethane, trimethylolpropane, pentaerythritol, or sorbitol; a phenol with three or more hydroxyl groups, that is, a trivalence or of a greater polyvalence, i.e., such as trisphenol PA, phenol novolac, or cresol novolac; as well as an alkylene oxide adductive of the polyphenol with three of more hydroxyl groups, that is, the trivalence or of the greater polyvalence polyphenol.

As the polyvalent carboxylic acid (PC), it would be possible to cite a divalent carboxylic acid (DIC) and polyvalent carboxylic acid (TC) with three or more hydroxyl groups, that is, a trivalence or of a greater polyvalence, and more preferably either entirely the divalent carboxylic acid or a compound of the divalent carboxylic acid (DIC) mixed with a small quantity of the polyvalent carboxylic acid (TC). As the divalent carboxylic acid (DIC), it would be possible to cite an alkylene dicarboxylic acid, i.e., such as succinic acid, adipic acid, or sebacic acid; an alkenylene dicarboxylic acid; i.e., such as maleic acid or fumaric acid; or an aromatic dicarboxylic acid, i.e., such as phthalic acid, isophthalic acid, terephthalic acid, or naphthalene dicarboxylic acid. Among the compounds listed herein, a preferable compound thereof would be $C_{4-20}$ alkenylene dicarboxylic acid and $C_{8-20}$ aromatic dicarboxylic acid. As the trivalent or greater polyvalent carboxylic acid (TC), it would be possible to cite, for example, $C_{0-20}$ aromatic polyvalent carboxylic acid, i.e., such as trimellitic acid or pyromellitic acid. It is to be understood that, as the polyvalent carboxylic acid (PC), it would be permissible to employ either an acid anhydride of the compounds described herein or a lower alkyl ester, i.e., such as methyl ester, ethyl ester, or isopropyl ester in a reaction with the polyvalent alcohol (PO).

A ratio of the polyvalent alcohol (PO) to the polyvalent carboxylic acid (PC), as an equivalence ratio of a hydroxyl group [OH] and carboxyl group [COOH], i.e., [OH]/[COOH], may normally be between 2/1 to 1/1, with a range thereof between 1.5/1 to 1/1 being preferable, and a range thereof between 1.3/1 to 1.02/1 being further preferable still.

The polycondensation reaction between the polyvalent alcohol (PO) and the polyvalent carboxylic acid (PC), provides a polyester, including the hydroxyl (OH) groups, by distilling a water generated while heating the compounds to between 150 degrees C. and 280 degrees C., and decompressing as necessary, in a presence of a known and established esterification catalyst such as tetrabutoxy titanate or dibutylthene oxide. It is preferable for the hydroxyl group [OH] valence of the polyester to be five or greater, whereas an acid value of the polyester would normally fall within a range of between 1 to 30, and more preferably a range of between 5 to 20. Imparting the acid value upon the toner makes it easier to generate a negative charge, furthermore improving an affinity between the recording paper and the toner when the toner is fixed upon the recording paper, thereby improving a low temperature fixing property. If the acid value of the toner exceeds 30, however, a trend emerges of a deterioration of a stability of the charge, and in particular with regard to a fluctuation in an environment therewith.

In addition, an average molecular volume by weight falls preferably into a range of between 10,000 to 400,000, and more preferably a range of between 20,000 to 200,000. An average molecular volume by weight of less than 10,000 is not preferable, owing to a deterioration thereby in a resistance to a hot offset. In addition, an average molecular volume by weight of greater than 400,000 is similarly not preferable, owing to a deterioration thereby in the low temperature fixing property.

In addition to a non-modified polyester obtained with the above-mentioned polycondensation reaction, a urea-modified polyester is also preferably included among the polyester. The urea-modified polyester is obtained by causing a reaction between such as a terminally-attached carboxyl group [COOH] or hydroxyl group [OH] of the polyester obtained with the above-mentioned polycondensation reaction and a polyvalent isocyanate compound (PIC) to obtain a polyester pre-polymer (A) including an isocyanate group, and by a further reaction between the polyester pre-polymer (A) and an amine to perform cross-linking and/or elongation of molecular chains.

As the polyvalent isocyanato compound (PIC), it may be possible to cite such as an aliphatic series polyvalent isocyanate, i.e., such as tetramethylene diisocyanate hexamethylene diisocyanate, or 2,6-diisocyanato methyl caproate; an alicyclic polyisocyanate, i.e., such as isophorone diisocyanate, or cyclohexylmethane diisocyanate; an aromatic diisocyanate, i.e., such as tolylene diisocyanate, or diphenylmethane diisocyanate; an aromatic aliphatic diisocyanate, i.e., such as $\alpha, \alpha, \alpha', \alpha'$-tetramethyl xylylene diisocyanate; an isocyanate: a compound that blocks the above polyisocyanate with such as a phenol derivative, an oxime, or a caprolactam; as well as a combination of any two or more above-mentioned compounds.

A ratio of the polyvalent isocyanate compound (PIC), as an equivalence ratio of the isocyanate group [NCO] and the hydroxyl group [OH] of the polyester, i.e., [NCO]/[OH] may normally be between 5/1 to 1/1, with a range thereof between 4/1 to 1.2/1 being preferable, and a range thereof between 2.5/1 to 1.5/1 being further preferable still. If the [NCO]/[OH] exceeds 5, the low temperature fixing property deteriorates. If a molar ratio of the isocyanate group [NCO] is less than 1, a quantity of urea contained in the ester will be low when employing the urea-modified polyester, resulting in a deterioration thereby in a resistance to a hot offset.

A content of a composition of a polyvalent isocyanate compound (PIC) in the polyester pre-polymer including the isocyanate group is normally in a range of between 0.5 wt % to 40 wt %, more preferably a range of between 1 wt % to 30 wt %, and a range of between 2 wt % to 20 wt % being further preferable still. When the content thereof is less than 0.5 wt %, not only the resistance to the hot offset deteriorates, but also, both a resistance to a heat resistance and preservation property and the low temperature fixing property are disadvantageous. In addition, when the content thereof is greater than 40 wt %, the low temperature fixing property deteriorates.

Normally, one or more isocyanate groups is included in a polyester pre-polymer (A) on a per molecule basis, more preferably with a range between 1.5 to 3 isocyanate groups on average on the per molecule basis, and further preferably a range between 1.8 to 2.5 isocyanate groups on average on the per molecule basis. If less than one isocyanate group on the per molecule basis is present, the molecular weight of the urea-modified polyester declines, and the resistance to the hot offset property deteriorates.

Next, as an amine (B) made to react with the polyester pre-polymer (A), it may be possible to cite such as a divalent amine compound (B1), a polyvalent amine compound (B2) with a trivalence or a higher valence thereof, an amino alcohol (B3), an amino mercaptane (B4), or an amino acid (B5), as well as a blocker (B6) that blocks the amino group B1 to B5.

As the divalent amine compound (B1), it may be possible to cite such as an aromatic diamine, i.e., such as phenylene diamine, diethyl toluene diamine, or 4,4'-diamino diphenylmethane; an alicyclic diamine, i.e., such as 4,4'-diamino-3,3'-dimethyl dicyclohexylmethane, diamine cyclohexane, or isophorone diamine; as well as an aliphatic diamine, i.e., such as ethylene diamine, tetramethylene diamine, or hexamethylene diamine. As the polyvalent amine compound (B2) with the trivalence or greater valence thereof, it may be possible to cite such as diethylene triamine or triethylene tetramine. As the amino alcohol (B3), it may be possible to cite such as ethanol amine or hydroxyethyl aniline. As the amino mercaptane (B4), it may be possible to cite such as aminoethyl mercaptane or aminopropyl mercaptane. As the amino acid (B5), it may be possible to cite such as aminopropionic acid or aminocaproic acid. As the blocker (B6) that blocks the amino groups B1 to B5, it may be possible to cite such as a ketimine compound or an oxazolidine compound that is obtained from the amine B1 to B5 and a ketone, i.e., such as acetone, methylethyl ketone, or methylisobutyl ketone. Of the above-cited amine (B), either B1 or a mixed compound of B1 with a small quantity of B2 is preferable according to the embodiment of present invention.

The ratio of the amine (B) as an equivalence ratio of the isocyanate group [NCO] in the polyester pre-polymer (A) and an amino group [NHx] in the amine (B) [NCO]/[NHx] may normally be within a range of 1/2 to 2/1, wherein a range of between 1.5/1 to 1/1.5 being preferable thereof, and a range of between 1.2/1 to 1/1.2 being further preferable still thereof. If the [NCO]/[NHx] is greater than 2 or less than 1/2, the molecular weight of the urea-modified polyester declines, and the hot offset resistance property deteriorates.

In addition, it may also be permissible for a urethane bond to be included in an urea-modified polyester, together with a urea bond. The molar ratio of the content of the urea bond to the content of the urethane bond may normally fall within a range of between 100/0 to 10/90, wherein a range of between 80/20 to 20/80 would be preferable, and a range of between 60/40 to 30/70 would be further preferable still. If the molar ratio of the urea bond is less than 10%, the resistance to the hot offset property will deteriorate.

The urea-modified polyester is manufactured by such as a one-shot method. The polyvalent alcohol (PO) and the polyvalent carboxylic acid (PC) is heated to between 150 degrees C. and 280 degrees C., in a presence of a known and established esterification catalyst such as tetrabutoxy titanate or dibutylthene oxide, and distilling a water generated while decompressing as necessary, thereby obtaining the polyester including the hydroxyl group [OH]. Thereafter, the polyester including the hydroxyl group [OH] is caused to react with the polyvalent isocyanate (PIC) at a temperature of between 40 degrees C. and 140 degrees C., and the polyester pre-polymer (A) including the isocyanate group is obtained as a result. The obtained polyester pre-polymer (A) including the isocyanate group is further caused to react with the amine (B) at a temperature of between 0 degrees C. and 140 degrees C., and the urea-modified polyester is obtained as a result.

It may also be possible to employ a solvent as necessary, when causing the (PIC) reaction, as well as when causing the reaction with the polyester pre-polymer (A) and the amine (B). As the solvent that may be permissible for the use thereof, it may be possible to cite a substance that is inert with regard to the isocyanate (PIC), such as an aromatic solvent, i.e., such as toluene or xylene; a ketone, i.e., such as acetone, methylethyl ketone, or methylisobutyl ketone; an ester, i.e., such as ethyl acetate; or an amide, i.e., such as dimethyl formamide or dimethyl acetamide; as well as an ether, i.e., such as tetrahydrofuran.

In addition, it may also be possible to employ a reaction terminator that cross-links and/or elongates the molecular chains of the polyester pre-polymer (A) and the amine group (B), and thereby to adjust the molecular weight of the obtained urea-modified polyester. As the reaction terminator, it may be possible to cite such as a monoamine, i.e., such as diethyl amine, dibutyl amine, butyl amine, or lauryl amine, as well as a blocker that blocks the substance, i.e., such as a ketimine compound.

A weight-average molecular weight of the urea-modified polyester is normally 10,000 or greater, wherein falling into a range of between 20,000 to 10,000,000, and falling into a range of between 30,000 to 1,000,000 is further preferable still. If the weight-average molecular weight of the urea-modified polyester is less than 10,000, the resistance to the hot offset property deteriorates. The number-average molecular weight of such as the urea-modified polyester is not particularly limited to a circumstance wherein the non-modified polyester is employed, and it may be permissible for an easy to obtain number of the number-average molecular weight to be treated as the weight-average molecular weight thereof. When the urea-modified polyester is used in isolation, the number-average molecular weight thereof normally falls within a range of between 2000 and 15,000, wherein a range of between 2000 and 10,000 may be preferable, and a range of between 2000 and 8000 is further preferable still. If the number-average molecular weight thereof exceeds 20,000, the low temperature fixing property and a gloss in a circumstance wherein the urea-modified polyester is employed upon the full color apparatus thereof both deteriorate.

Combining the non-modified polyester with the urea-modified polyester improves the gloss in the circumstance wherein the urea-modified polyester is employed upon the full color image forming apparatus 100, and thus, is preferable to using only the urea-modified polyester therewith. It is to be understood that it may also be permissible for the non-modified polyester to include polyester that is modified by a chemical bond other than the urea bond.

It is preferable for at least a portion of the non-modified polyester and the urea-modified polyester to be compatibilized, with respect to the low temperature fixing property and the resistance to the hot reset property. Accordingly, it is preferable that the non-modified polyester includes a similar constitution to the urea-modified polyester.

In addition, a weight ratio of the non-modified polyester to the urea-modified polyester falls normally within a range of between 20/80 to 95/5, wherein a range of between 70/30 and 95/5 is preferable, a range of between 75/25 and 95/5 is further preferable still, and a range of between 80/20 and 93/7 is especially preferable. If the weight ratio of the urea-modified polyester is less than 5%, not only the resistance to the hot offset deteriorates, but also, both the resistance to the hot offset property and the low temperature fixing property are disadvantageous.

A glass transition point (Tg) of the binder resin including the non-modified polyester and the urea-modified polyester falls normally within a range of between 45 degrees C. to 65 degrees C., wherein a range of between 45 degrees C. to 65 degrees C. is preferable. If the glass transition point thereof is less than 45 degrees C., a heat resistance of the toner deteriorates, whereas if the glass transition point thereof is greater than 64 degrees C., the low temperature fixing property is rendered inadequate.

In addition, the urea-modified polyester easily exists on a surface of a base particle of the toner and demonstrates a more positive trend with regard to the thermal resistance and thermal preservation property than a known and established polyester toner.

(Coloring Agent)

It would be possible to use a full range of a known and established dyes and pigments as a coloring agent according to an embodiment of the present invention. As an instance thereof, it may be possible to use carbon black, nigrosine dye, iron black, naphthol yellow S, hansa yellow (10G, 5G, G), cadmium yellow, yellow iron oxide, ocher, chromium yellow, titanium yellow, poly azo yellow, oil yellow, hanza yellow (GR, A, RN, R), pigment yellow L, benzidine yellow (G, GR), permanent yellow (NCG), vulcan fast yellow (5G, R), tartrazine lake, quinoline yellow lake, anthrazan yellow BGL, isoindolinone yellow, bengala, minium (red lead), crimson lead, cadmium red, cadmium mercury red, crimson antimony, permanent red 4R, para red, fisay red, parachloroltonitro aniline red, a lithol fast scarlet G, brilliant fast scarlet, brilliant carmine BS, permanent red (F2R, F4R, FRL, FRLL, F4RH), fast scarlet VD, a vulcan fast rubin B, brilliant scarlet G, a lithol rubin GX, permanent red F5R, brilliant carmine 6B, pigment scarlet 3B, bordeaux 5B, toluidine maroon, permanent bordeaux F2K, helio bordeaux BL, bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, poly azo red, chromium vermillion, benzidine orange, perinone orange, oil orange, cobalt blue, cerulean blue, alkali blue lake, peacock blue lake, victoria blue lake, nonmetallic phthalocyanin blue, phthalocyanin, blue, fast sky blue, indanthrene blue (RS, RC), indigo, lapis lazuli, ultramarine, anthraquinone blue, fast violet B, methyl violet lake, cobalt purple, manganese purple, dioxane violet, anthraquinone violet, chromium green, zinc green, chromium oxide, viridian, emerald green, pigment green B, naphthol green B, green gold, acid green lake, malachite green lake, phthalocyanin green, anthraquinone green, titanium oxide, zinc oxide, or lithopone, as well as a compound thereof. A content of the coloring agent may normally fall within a range of between 1% and 15% of the toner, and a range therein of between 3% and 10% of the toner is preferable.

It may also be possible to employ a composite compound of the coloring agent with the resin as a master batch. It may be possible to cite as a construction of the master batch, or as the binder resin that is mixed with the master batch, either a polymer of styrene, i.e., such as polystyrene, poly-p-chlorostyrene, or polyvinyl toluene, as well as a substitute polymer thereof, or else a copolymer thereof with a vinyl compound, polymethyl methacrylate, polybutyl methacrylate, polyvinyl chloride (PVC), polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, an aliphatic or alicyclic hydrocarbon resin, an aromatic petroleum resin, a chlorinated paraffin, or a paraffin wax, either singly or as a compound therewith.

(Charge Control Agent)

It may be possible to use a known and established technology as a charge control agent. Such a charge control agent, as an instance thereof, may be a nigrosine group dye, a triphenylmethane group dye, a metal complex dye including chromium, a molybdate chelate pigment, a rhodamine group dye, an alkoxy group amine, a quaternary ammonium chloride (including a fluorine modified quaternary ammonium chloride), an alkyl amide, phosphorus (either alone or in a compound), tungsten (either alone or in a compound), a fluorine group activator, a salicylic acid metallic salt, or a metallic salt of a salicylic acid derivative. More specifically, it may be possible to cite such as the nigrosine group dye bontoron 03, the quaternary ammonium chloride bontoron P-51, the metallic azo dye bontoron S-34, the oxynaphthoic acid group metal complex E-82, the salicylic acid group metal complex E-84, or the phenol group condensate E-89 (all manufactured by Orient Chemical Industries, Ltd.), as well as a quaternary ammonium chloride molybdenum complex TP-302 or TP-415 (both manufactured by Hodogaya Chemical Co., Ltd.), as well as a quaternary ammonium chloride copy charge PSYV2038, a triphenylmethane derivative copy blue PR, a quaternary ammonium chloride copy charge NEGV2036, or a copy charge NXVP434 (all manufactured by Hoechst), an LRA-901, or a boron complex LR-147 (both manufactured by Japan Carlit Co., Ltd.), a copper phthalocyanin, a perylene, a quinacridone, an azo group pigment, or another compound of a macromolecule including a functional group, such as a sulfonic acid group, a carboxyl group [COOH], or a quaternary ammonium chloride compound, in addition thereto. In particular, a material thereamong that controls a negative polarity of the toner is preferable herein.

An amount of a usage of the charge control agent is determined by a method of manufacturing the toner, including a method of distributing, a type of the binder resin, and a presence or lack of a used additive as necessary, and thus, is not limited to a single definition. It may be preferable, however, for a range of a weight portion thereof with regard to a binder resin 100 weight portion to fall between a 0.1 weight portion and a 10 weight portion. It would be preferable for the range of the weight portion thereof to fall between a range of 0.2 weight portion and 5 weight portion. If the range thereof exceeds a 10 weight portion, the charge of the toner becomes too great, causing an effect of the charge control agent to deteriorate, potentially leading to an increase of an electrostatic attraction between the toner and the development roller, a decline of a fluidity of the developer, or a decline of an image concentration.

(Release Agent)

As the release agent, a wax with a low melting point of between 50 degrees C. and 120 degrees C. functions between the fixing roller and an interface of the toner, in a dispersion in which it is dispersed with the binder resin, thereby demonstrating an effect with regard to a high temperature offset without coating an oily release agent upon the fixing roller. It would be possible to cite a substance listed hereinafter as a wax component: as a candle wax or another type of wax thereof, it would be possible to cite a plant matter type wax, i.e., a carnauba wax, a fiber wax, a vegetable wax, or a rice wax; an animal matter type wax, i.e., such as a beeswax or a lanolin; a mineral type wax, i.e, such as an ozokerite or a cercine, as well as a petroleum wax, i.e., such as paraffin, a micro crystalline, or a petrolatum, or the like. In addition, it would be possible to cite, aside from such a natural wax as is cited herein, a synthetic hydrocarbon wax, i.e, such as a Fischer-Tropsch wax or a polyethylene wax; or a synthetic wax, i.e., such as an ester, a ketone, or an ether wax. Furthermore, it would be possible to employ such as a crystalline macromolecule including a long side chain alkyl group, i.e., a fatty acid amide, i.e., such as a 12-hydroxyl stearamide, a stearamide, a phthalic anhydride imide, or a chlorinated hydrocarbon, as well as a polyacrylate homopolymer or a copolymer, i.e., a crystalline macromolecule resin with a low molecular weight, a poly-n-stearylmethacrylate, or a poly-n-laurylmethacrylate; as an instance thereof, an n-stearylacrylate-ethylmethacrylate copolymer.

It would also be possible to fuse the charge control agent and the release agent together with the master batch and the binder resin, and it is to be understood that it would also be permissible to dissolve or distribute the charge control agent and the release agent within an organic solvent.

(Additive)

It is preferable for an inorganic particle to be employed as an agent imparting fluidity, a development capability, and a charge of the toner grain. It would be preferable for a first grain diameter of the inorganic particle to fall into a range of between $5\times10^{-3}$ μm to 2 μm, with a range of between $5\times10^{-3}$ to 0.5 μm being particularly preferable. In addition, it would be preferable for a specific surface area according to a BET method to fall within in a range of between 20 $m^2/g$ and 500 $m^2/g$. It would be preferable for a percentage of a usage of the inorganic particle to fall into a range of between 0.01 wt % and 5 wt % of the toner, with a range of between 0.01 wt % and 2.0 wt % being particularly preferable.

As an instance of the inorganic particle, it would be possible to cite, a silica, an alumina, a titanium oxide, a barium titanate, a magnesium titanate, a calcium titanate, a strontium titanate, a zinc oxide, a stannous oxide, a silica sand, a clay, a mica, a wollastonite, a diatomite, a chromium oxide, a cerium oxide, a bengala, an antimony trioxide, a magnesium oxide, a zirconium oxide, a barium sulfate, a barium carbonate, a calcium carbonate, a silicon carbide, or a silicon nitride. Of the above substances, a preferable substance as a fluidity imparting agent would be a combination of a hydrophobic silica particle and a hydrophobic titanium oxide particle. In particular, in a circumstance wherein an agitation mixing is performed upon both of the particles thereof, which have an average particle size of less than $5\times10^{-2}$ μm, an electrostatic force and a Van der Waals attraction between the mixture of the hydrophobic silica particle and the hydrophobic titanium oxide particle and the toner increases significantly, and it is thereby possible to obtain a high image quality. Thus, the fluidity imparting agent does not detach from the toner, and such as a local transfer defect that may take on an appearance of a firefly light does not arise within the image, even if by mixing thereof within the developing device that is being performed in order to obtain a desired level of the electric charge. In addition, it is further possible to minimize the amount of the toner that remains after the transfer of the image thereby has taken place.

The titanium oxide particle has a superior degree of an environmental safety and a stability of the image density thereof, whereas the titanium oxide particle suffers from a tendency to degrade with regard to a property of electrical charge activation. It is thought that as a quantity of the titanium oxide particle addition increases beyond a quantity of the silica particle addition thereto, an impact by the side effect of the degradation with regard to the property of electrical charge activation further increases. If, however, the quantity of the addition of the hydrophobic silica particle and the quantity of the addition of the hydrophobic titanium oxide particle falls into a range of between 0.3 wt % and 1.5 wt %, the property of electrical charge activation is not significantly impaired, and it is thereby possible to obtain a desired electrical charge activation, or, put another way, it is possible to obtain a steady image quality even if a repetition of a given copy is performed.

The method of manufacturing the toner will be explained. Whereas a preferred method of manufacturing the toner is depicted herein, it is to be understood that the present invention is not limited thereto.

(Toner Manufacturing Method)

1) A toner material fluid is made by dispersing the coloring agent, the non-modified polyester, the polyester pre-polymer, including the isocyanate group, and the release agent in the organic solvent.

It would be preferable for the organic solvent to include a boiling point of less than 100 degrees C., because such a property simplifies a removal of the organic solvent after a formation of the toner base particle. As an example, it would be possible to employ toluene, xylene, benzene, carbon tetrachloride, methane dichloride, 1,2-dichloroethane, 1,1,2-trichloroethane, trichloroethylene, chloroform, monochlorobenzene, dichloroethylidene, methyl acetate, ethyl acetate, methylethyl ketone, or methylisobutyl ketone, either singly or in a combination of two or more thereof. In particular, an aromatic solvent, such as toluene or xylene, would be preferable, as would a hydrocarbon halide, such as methane dichloride, 1,2-dichloroethane, chloroform, or carbon tetrachloride. A quantity of usage of the organic solvent with regard to 100 parts of the polyester pre-polymer would normally fall within a range of between 0 and 300 parts, with a range of between 0 and 100 parts being preferable, and a range of between 25 and 70 parts being further preferable still.

2) The toner material fluid is emulsified within an aqueous medium, in the presence of a surfactant and a resin particle.

It would be permissible for the aqueous medium to include only water, as well as to further include an organic solvent, such as an alcohol, i.e., such as methanol, isopropyl alcohol, or ethylene glycol, as well as dimethyl formamide, tetrahydrofuran, a cellosolve, i.e., such as methyl cellosolve, or a lower ketone, i.e., such as acetone or methylethyl ketone.

A quantity of usage of the aqueous medium with regard to 100 parts of the toner material solution would normally fall within a range of between 50 and 2000 parts, with a range of between 100 and 1000 parts being preferable. A quantity of usage of the aqueous medium of less than 50 parts would result in an inadequate dispersion of the toner material solution, thereby precluding obtaining a toner particle of a prescribed grain diameter. Conversely, a quantity of usage of the aqueous medium of greater than 20,000 parts would not be economical.

In addition, a dispersing agent, such as the surfactant or the resin particle, is added to the aqueous medium as appropriate to maintain a suitable state of the dispersion of the toner material solution.

As the surfactant, it would be possible to cite an anionic surfactant, such as alkyl benzene sulfonate, α-olefin sulfonate, or an organophosphate, a cationic surfactant, such as an amine chlorate, i.e., such as an alkyl amine chlorate, an amino alcohol fatty acid derivative, or a polyamine fatty acid derivative, or a quaternary ammonium chloride, i.e., such as imidazoline, alkyl trimethyl ammonium chlorate, dialkyl dimethyl ammonium chlorate, alkyl dimethyl benzyl ammonium chlorate, pyridinium chlorate, alkyl isoquinolinium chlorate, or benzethonium chloride, or a nonionic surfactant, such as a fatty acid amide derivative or a polyvalent alcohol derivative, or an amphoteric surfactant, i.e. An instance thereof would be alanine, dodecyl di(amino ethyl)glycine, di(octyl amino ethyl)glycine, or N-alkyl-N,N-dimethyl ammonium betaine.

In addition, it would be possible to demonstrate an effect with a significantly small quantity of a surfactant by employing a surfactant including a fluoroalkyl group. As an anionic surfactant including the fluoroalkyl group preferably employed, it would be possible to cite such as $C_{2-10}$ fluoroalkyl carboxylic acid, as well as a metallic salt thereof, perfluorooctane sulfonil disodium glutamate, 3-[ω-fluoroalkyl ($C_{6-11}$) oxy]-1-alkyl ($C_{3-4}$) sodium sulfonate, 3-[ω-fluoroalkanoyl (C6-C8)-N-ethyl amino]-1-propane sodium sulfonate, fluoroalkyl (C11-C12) carboxylic acid, as well as a metallic salt thereof, perfluoroalkylcarboxylic acid (C7-C13), as well as a metallic salt thereof, perfluoroalkyl (C4-C12) sulfonamide, as well as a metallic salt thereof, perfluorooctane sulfonic acid diethanol amide, N-propyl-N-(2-hydroxyethyl)perfluorooctane sulfonamide, perfluoroalkyl (C6-C10) sulfonamide propyltrimethyl ammonium chlorate, perfluoroalkyl (C6-C10)-N-ethyl sulfonilglycinate, or monoperfluoroalkyl (C6-C10) ethyl phosphate.

As a product name thereof, it would be possible to cite such as Surflon S-111, S-112, and S-113 (manufactured by Asahi Glass Co., Ltd.), Fluorad FC-93, FC95, FC-98, and FC-129 (manufactured by 3M (Sumitomo 3M)), Unidyne DS-101 and DS-102 (manufactured by Daikin Industries, Ltd.), Megaface F-110, F-120, F-113, F-191, F-812, and F833 (manufactured by DIC Corporation), EFTOP EF-102, 103, 104, 105, 112, 123A, 123B, 306A, 501, 201, and 204 (manufactured by Tohkem Products Corporation), and Ftergent F-100 and F-150 (manufactured by Neos Co., Ltd.).

In addition, as the cationic surfactant, it would be possible to cite such as an aliphatic primary, secondary, or secondary amino acid including a fluroalkyl group, an aliphatic quaternary ammonium chloride such as perfluoroalkyl (C6-C10) sulfonamide propyltrimethyl ammonium chlorate, benzalkonium chlorate, benzethonium chloride, pyridinium chlorate, or imidazoline chlorate, and it would also be possible to cite, as the product name thereof, such as Surflon S-121 (manufactured by Asahi Glass Co., Ltd.), Fluorad FC-135 (all manufactured by 3M (Sumitomo 3M)), Unidyne DS-202 (manufactured by Daikin Industries, Ltd.), Megaface F-150 and F-824 (both manufactured by DIC Corporation), EFTOP EF-132 (manufactured by Tohkem Products Corporation), and Ftergent F-300 (manufactured by Neos Co., Ltd.).

The resin particle is added in order to stabilize the toner base particle that is formed within the aqueous medium. As a consequence thereof, it is preferable that a degree of a coating on the surface of the toner base particle falls within a range of between 10% and 90%. As an instance thereof, it would be possible to cite such as a polymethacrylic acid methyl particle of both a 1 μm and a 3 μm size, a polystyrene particle of both a 0.5 μm and a 2 μm size, and a poly(styrene-acrylonitrile) particle of a 1 μm size, and it would also be possible to cite, as the product name thereof, such as PB-200H (manufactured by Kao Corporation), SGP (manufactured by Soken Chemical and Engineering Co., Ltd.), Technopolymer SB (manufactured by Sekisui Plastics Co., Ltd.), SGP-3G (manufactured by Soken Chemical and Engineering Co., Ltd.), and Microsphere (manufactured by Sekisui Chemical Co., Ltd.).

In addition, it would be possible to employ an inorganic compound dispersing agent such as tricalcium phosphate, calcium carbonate, titanium oxide, colloidal silica, or apatite hydroxyl.

As the dispersing agent that may be used as the inorganic compound dispersing agent in combination with the resin particle, it would also be permissible to stabilize a dispersing fluid drip by way of a macromolecular protective colloid. As an instance thereof, it would be possible to use an acid, such as acrylic acid, methacrylic acid, α-cyanoacrylic acid, α-cyanomethacrylic acid, itaconic acid, crotonic acid, fumaric acid, maleic acid, or maleic anhydride, or an acrylate (or methacrylate) monomer including a hydroxyl group [OH], as an instance thereof, such as acrylic acid-β-hydroxyethyl, methacrylic acid-β-hydroxyethyl, acrylic acid-β-hydroxypropyl, methacrylic acid-β-hydroxypropyl, acrylic acid-γ-hydroxypropyl, methacrylic acid-γ-hydroxypropyl, acrylic acid-3-chloro2-hydroxypropyl, methacrylic acid-3-chloro-2-hydroxypropyl, diethylene glycol monoacrylic acid ester, diethylene glycol monomethacrylic acid ester, glycerine monoacrylic acid ester, glycerine monomethacrylic acid ester, N-methylol acrylate amide, or N-methylol methacrylate amide, vinyl alcohol or a vinyl alcohol ether, as an instance thereof being such as vinylmethyl ether, vinylethyl ether, or vinylpropyl ether, or an ester of a compound that comprises a vinyl alcohol and a carboxyl group [COOH], as an instance thereof being such as vinyl acetate, vinyl propionate, or vinyl butyral, acrylamide, methacrylamide, diacetone acrylamide, or a methylol compound thereof, or a chloride such as acrylic chloride or methacrylic chloride, a nitrogen compound such as vinylpyridine, vinylpyrrolidine, vinylimidazole, or ethyleneimine, or a homopolymer or a co-polymer including a heterocycle thereof, a polyoxyethylene group such as polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene lauryl phenylether, polyoxyethylene stearyl phenylester, or polyoxyethylene nonylphenyl ester, or a cellulose group such as methylcellulose, hydroxyethyl cellulose, or hydroxypropyl cellulose.

Whereas the method of the dispersion is not limited in a particular manner according to the present invention, it would be possible to apply a known and established infrastructure, such as a low speed shearing system, a high speed shearing system, a friction system, a high pressure jet system, or an ultrasound. The high speed shearing system from thereamong is preferable, given that it provides a grain diameter of a dispersal body of between 2 μm to 20 μm. Whereas a rotational speed is not particularly limited in a circumstance wherein a high speed shearing system disperser is used, the rotational speed thereof would normally fall within a range of between 1000 rpm to 30,000 rpm, with a range of between 5000 rpm to 20,000 rpm being preferable. Whereas a time for the dispersal is not particularly limited according to the present invention, the time thereof with a batching system normally falls into a range of between 0.1 minute and five minutes. As a temperature when the dispersal is performed, the temperature normally falls into a range of between 0 degrees C. and 150 degrees C. (under pressure), with a range of between 40 degrees C. and 98 degrees C. being preferable.

3) Simultaneous with the production of the emulsion, the amine (B) is added, and a reaction caused between the amine (B) and the polyester pre-polymer (A) including the isocyanate group.

The reaction is in accordance with the cross-linking and/or elongation of the molecular chains. Whereas a time for the reaction is selected based on a reactivity of a structure of the isocyanate group of the polyester pre-polymer (A) with the amine group (B), the time for the reaction would normally fall into a range of between 10 minutes and 40 hours, with a range therein of between two hours and 24 hours being preferable. A temperature of the reaction would normally fall into a range of between 0 degrees C. and 150 degrees C., with a range of between 40 degrees C. and 98 degrees C. being preferable. In addition, it would be possible to use a known and established catalyst as necessary. As a particular catalyst thereof, it would be possible to cite such as dibutyl ethene laurate or dioctyl tin laurate.

4) After the above reaction is completed, the organic solvent is removed from the emulsified dispersal body, i.e., the reactant, which is washed and dried to obtain the toner base particle.

In order to remove the organic solvent, the temperature of the overall reaction mass is gradually increased with an agitation state of a laminar flow, thus allowing producing a toner base particle of a spindle shape by performing a desolvation after a powerful agitation has been applied within a given temperature region. In addition, in a circumstance wherein an acid, i.e., a substance that is capable of dissolving in an alkali solution, such as calcium phosphate chloride, as a dispersal stabilization agent, after dissolving the calcium phosphate chloride by an acid such as hydrochloric acid, the calcium phosphate chloride is removed from the toner base particle by way of a method such as a flushing by water. It would also be possible to remove the calcium phosphate chloride by way of another operation thereupon, such as dissolving the calcium phosphate chloride with an enzyme.

5) The charge control agent is poured into the toner base particle that is obtained by way of the above-described method, and the inorganic particle, such as the silica particle or the titanium oxide particle is added thereto, to obtain the toner.

The pouring of the charge control agent into the toner base particle, as well as the adding of the inorganic particle thereto, is performed by a known and established method that employs such as a mixer.

It is thus possible to easily obtain a toner with a small grain diameter and a sharp grain diameter distribution. Furthermore, applying the strong agitation in the process for removing the organic solvent allows controlling a shape of the toner particle from a sphere to an oblong, and moreover allows controlling a morphology of the surface thereof from a smooth surface to a wrinkled and pitted surface thereof.

In addition, the shape of the toner according to the embodiment is a spheroidal shape, and it is possible to represent the shape thereof by way of a shape regulation as described hereinafter.

Figure 7A:
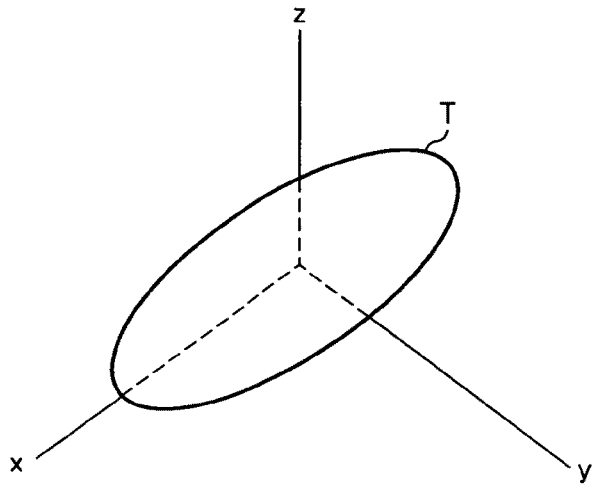
FIG. 7(A) is a perspective view of a toner particle.
Figure 7B:
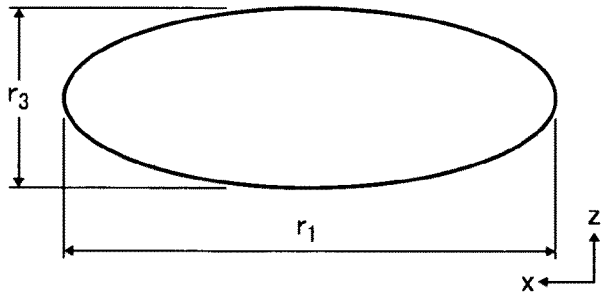
FIG. 7B is a schematic view illustrating a ratio of a long axis of a toner particle to a short axis of the toner particle.
Figure 7C:
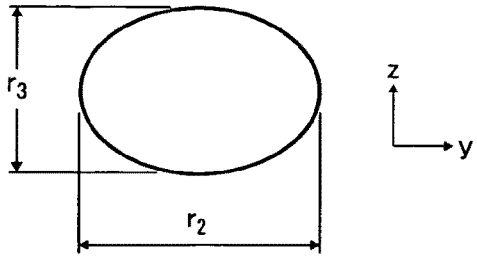
FIG. 7C is a schematic view illustrating a ratio of a thickness of a toner particle to a short axis of the toner particle.

FIG. 7 is a schematic view illustrating the shape of the toner according to the embodiment. When regulating the spheroidally shaped toner with a length axis r1, a width axis r2, and a thickness axis r3, wherein r1≥r2≥r3, it is preferable for a ratio of the width axis to the length axis, i.e., r2/r1, of the toner according to the embodiment to fall within a range of between 0.5 and 1.0, as shown in FIG. 7B, and for a ratio of the thickness to the width axis, i.e., r3/r2, to fall within a range of between 0.7 and 1.0, as shown in FIG. 7C. If the ratio of the width axis to the long axis, i.e., r2/r1, is less than 0.5, the shape of the toner deviates from the spherical, and, as a consequence, a dot reproducibility and a transfer efficiency deteriorate, precluding obtaining a high grade of image quality as a result. In addition, if the ratio of the thickness to the width axis, i.e., r3/r2, is less than 0.7, the toner approaches a flattened shape, precluding obtaining a high transfer rate such as would be possible with the spherical toner. In particular, when the ratio of the thickness to the width axis, i.e., r3/r2, is 1.0, the toner becomes a rotating body about the long axis thereof, thereby allowing improving the fluidity of the toner.

It is to be understood that it would be possible to measure the r1, the r2, and the r3 by way of the following method, as an instance thereof. Put another way, with regard to applying a toner on a smooth, level surface for the measurement with a uniform distribution for 100 toner particles, it would be possible to magnify the toner particles 500× with a Color Laser Microscope VK-8500 (manufactured by Keyence Corporation), thereby to measure the length axis r1 (in μm), the width axis r2 (in μm), and the thickness r3 (in μm) of the 100 toner particles thus magnified, and to derive the each respective arithmetic mean thereof.

The image forming apparatus according to an embodiment of the present invention may further include a plurality of supplying containers each configured to store the developer. Each of the plurality of supplying containers is replaceably provided. The plurality of supplying containers include a black toner supplying container configured to store the black toner, and a color toner supplying container configured to store the toner of the color other than black. A proportion of the carrier included in the black toner supplying container is greater than a proportion of the carrier included in the color toner supplying container.

A proportion of the carrier in the developer supplied to the black developing device may be substantially 20 wt % and a proportion of the carrier in the developer supplied to the color developing device may be substantially 10 wt %.

EXAMPLE

Each respective imaging system condition according to the embodiment is as follows:

(Mechanical Condition)

photoconductor linear velocity: 383 (mm/sec);
development roller linear velocity: 575 (mm/sec);
development roller diameter: 25 (mm); and
developer pump volume (within developing region): 38 (mg/sq. cm).

The carrier and the toner which is used in the embodiment will be explained.

The black toner and the color toner, i.e., the yellow, the cyan, and the magenta toner, is identical aside from a difference in the respective color thereof. The carrier is also common across each respective color. It is preferable that the weight-average grain diameter of the carrier falls preferably within a range of between 20 μm and 65 μm. If the weight-average grain diameter of the carrier is less than 20 μm, a uniformity of the carrier particle declines, and a carrier deposition or adhesion may easily occur as a result. If, on the other hand, the weight-average grain diameter of the carrier is greater than 65 μm, the reproducibility of a finespun portion of the image declines, complicating obtaining a finely finespun image as a result. It is to be understood that it would be possible to employ an SRA type of a Microtrac particle size analyzer (manufactured by Nikkiso Co., Ltd.), to measure the weight-average grain diameter by volume of the carrier, setting a range thereof to fall between 0.7 μm and 125 μm. In such a circumstance, as an instance thereof, methanol is used as a medium of the dispersing agent, a refraction index thereof is set to 1.33, and a refraction index of the carrier is set to 2.42.

It is preferable for an average thickness of a coating of the carrier to fall within a range of between 0.05 μm and 4.00 μm, and it would be further preferable still for the range thereof to be between 0.05 μm and 1.00 μm. If the average thickness of the coating of the carrier is less than 0.05 μm, the average thickness of the coating thereof will be inadequate to cover a protrusion portion that arises upon the carrier particle, and, as a consequence thereof, a resistance thereof may easily deteriorate, owing to the protrusion portion thereof being abraded, and a core material of the carrier being exposed as a result. In addition, if the average thickness of the coating of the carrier is greater than 4.00 μm, then, as the carrier increases in size, the charge performance will deteriorate, and deterioration in a precision of an image may easily arise as a result.

A detailed formula thereof is as follows:

silicon resin solution (solid content 15 wt %);
SR2411: 227 parts, manufactured by Dow Corning Toray;
γ-(2-aminoethyl)aminopropyl trimethoxysilane: 6 parts;
alumina particles [0.3 μm, fixed resistance $10^{14}$ (Ω·cm)]: 160 parts;
toluene: 900 parts; and
butyl cellsolve: 900 parts.

The above materials are dispersed in a homo mixer for 10 minutes, and a carrier particle coating forming solution is compounded thereby. A calcined ferrite grain [F-300; average grain diameter: 50 μm (manufactured by Powder Tech)] is employed as a core material of the carrier, and the carrier particle coating forming solution is applied to a surface of the core material with a thickness of 0.15 μm, and dried by a Spira Cota (manufactured by Okada Seiko Co., Ltd.). The obtained carrier thereby is burned in an electrical furnace for two hours at 300 degrees C. A filter with a pore size of 100 μm is employed to separate a bulk ferrite particle mass after cooling thereof, and a resulting product is treated as the carrier.

According to the embodiment, a pre-mixing proportion of the black pre-mixed toner, i.e., a proportion of the carrier within the black pre-mixed toner, is set to be greater than the proportion of the carrier within color pre-mixed toner. A specific proportion thereof is treated as a following condition:

Pre-mixing proportion:

Black: approximately 20 wt %;

magenta, cyan, yellow: approximately 10 wt %.

As a method of assessing a degree of deterioration of the carrier, a transition of a scrapping or an abrasion of the coating of the carrier over time is estimated based on a transition of a static resistance of the carrier over time with regard to an operating time of the developing device. The carrier static resistance value is determined as follows: the toner in the developer is removed with a blow-off device to obtain the carrier, the thus obtained carrier is inserted between a pair of parallel resistance meter electrodes, having a gap of 2 mm therebetween, a current of 200V DC is impressed, and a resistance value measured with a high resistance meter after 30 seconds is converted into a volume resistivity, which is set to a value R. As an instance thereof, a target value of the static resistance value R with regard to the development condition according to the embodiment is Log R, i.e., 10(Ω·cm). If the Log R is less than 10, in particular when an electric potential difference between a development bias value impressed on the development roller and an electric potential of the electrostatic latent image on the photoconductor is large, the carrier is released from the development roller and adheres to or deposits on the electrostatic latent image on the photoconductor, that is, the carrier adhesion or deposition phenomenon is easily occur, and a white spot may occur within an solid image portion. Given that a cause of the decline of the resistance is a scrapping or abrasion of the carrier, it is possible to reduce a quantity of the decline of the resistance by reducing the scrapping or abrasion of the carrier.

Figure 8:
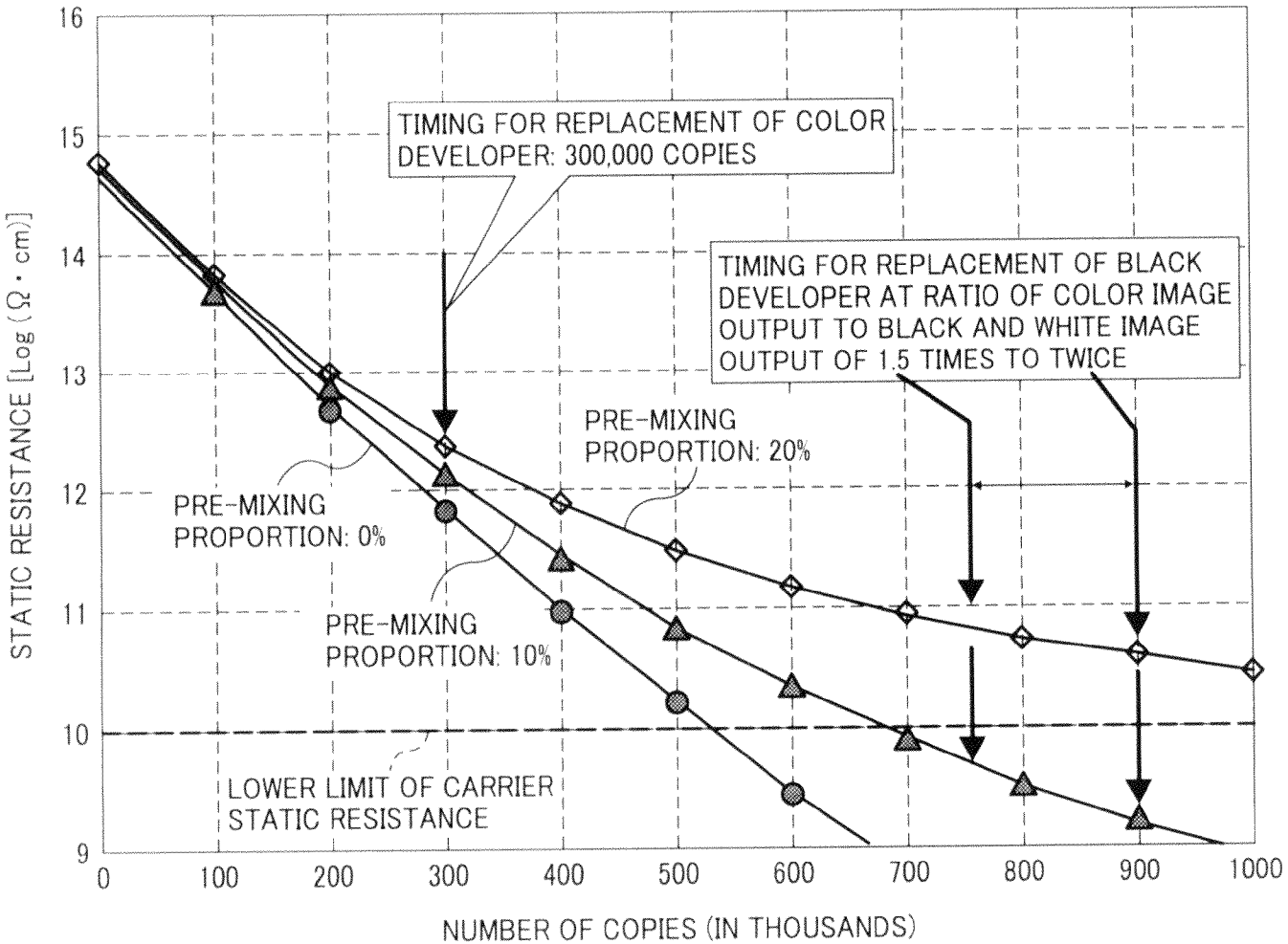
FIG. 8 is a view illustrating a transition of a static resistance of the carrier over time according to number of copies, in embodiments of the present invention.

A result of performing an assessment of a paper pass through under the condition according to the embodiment, and deriving the transition of the carrier static resistance value over time with regard to a quantity of the paper that is passed through, i.e., a substitute value for the run time of the image forming apparatus, is shown in FIG. 8.

FIG. 8 is a graph that depicts the transition of a static resistance of the carrier over time in response to the number of copies in the embodiment. The paper pass through condition of the copy is an image with a degree of blackening of the surface area of the image of 5%, which is carried out as a single job in a horizontal conveyance with a sheet of A4 size paper. It is possible to verify an improvement in slowing down a speed of deterioration of the carrier by using the pre-mixed toner, as shown in FIG. 8.

Taking into account an anomaly arising from the scrapping or abrasion, i.e., the deterioration in the carrier coat, such as occurrence of the white spot in the image, if treating the pre-mixing proportion, i.e., the proportion of the carrier in the pre-mixed toner, has a limit of 450,000 copies for an interval for changing the developer with supplying a 10% supplement of the developer, it is possible to hypothesize a more comfortable 300,000 copies for the interval for changing the developer by the visit from the serviceman, as per actual market conditions thereof.

In addition, whereas the frequency of the outputting of the full color image and the frequency of the outputting of the black and white image varies from one user to another, it is presumed in the present application that the frequency of the outputting of the black and white image is between 1.5 times and twice the frequency of the outputting of the full color image. In such a circumstance, when the full color image is outputted, the developing device 18, that is, the black-toner developing device which employs the black toner, operates together with the developing device 18, that is, the color-toner developing device which employs the color toner. Accordingly, the black-toner developing device 18 will operate a further 1.5 times to twice the frequency of the color-toner developing device 18. Consequently, if the interval of the replacement of the color-toner developing device 18 is presumed to be 300,000 copies, it becomes necessary to further presume that the interval of the replacement of the black-toner developing device 18, to fall into a range of between 450,000 and 600,000 copies, resulting thereby in an interval of the developing device 18 to fall into a range of between 750,000 and 900,000 copies total.

As a consequence thereof, given the change of the static resistance of the carrier over time, as shown in FIG. 8, when the pre-mixing proportion is 0%, the Log R falls below 10 (Ω·cm) when the number of copies approaches 500,000 copies, owing to the scrapping or abrasion of the carrier coat thereby, and an anomalous image is represented thereby, that is, for example, the white spot phenomenon occurs. When the pre-mixing proportion is 10%, the Log R falls below 10 (Ω·cm) when the number of copies approaches 700,000 copies, owing to the scrapping or abrasion of the carrier coat thereby, and the anomalous image is represented thereby, that is, for example, the white spot phenomenon occurs. When the pre-mixing proportion is 10%, the Log R is greater than or equal to 10(Ω·cm) up to a point whereat the number of copies approaches 1,000,000 copies, and the anomalous image, such as the white spot phenomenon, is not represented thereby.

In such a circumstance, treating the pre-mixing proportion of the black-tonner developer that employs the black toner to be 20%, which is 10% greater than the pre-mixing proportion of the color-toner developer that employs the color toner facilitates using the image forming apparatus 100 without occurring an anomalous phenomenon in the black image until when the replacement of the color toner developer is required.

Increasing the pre-mixing proportion extends the useful lifetime of the developer, and a reason for increasing the pre-mixing proportion of only the black toner, regardless of a decline in the frequency of the replacement of the developer, is as follows.

First of all, an increase in the pre-mixing proportion results in an increase in the quantity of the carrier in a single bottle of the developer, such that, when a quantity of the toner added to the bottle is the same as that in a case where the pre-mixing proportion is not increased, the bottle with the increased pre-mixing proportion will experience a further increase in an overall capacity thereof than the bottle with the lower pre-mixing proportion. Put another way, such a circumstance would be disadvantageous with regard to a manufacturing time or cost, as well as a space thereof within the image forming apparatus.

The pre-mixing proportion with regard to the color toner according to an embodiment of the present invention is set so as to optimize the manufacturing cost and the space required thereby within the image forming apparatus. If, however, in the present circumstance, the black-toner developer is set to a pre-mixing proportion similar to the pre-mixing proportion of the color-toner developer, then a gap will arise between the interval for the replacement of the black-toner developer, which is used at the higher frequency, and the interval for the replacement of the color-toner developer, thus resulting in a wastage thereof.

Accordingly, as an optimal method of resolving such an issue, the present invention increases the pre-mixing proportion of the black toner, thereby eliminating the wastage with regard to the replacement of the developer, while also keeping the problem of the manufacturing cost and the space required in the image forming apparatus to a minimum.

In the image forming apparatus according to an embodiment of the present invention, the proportion of the carrier included in the black pre-mixed toner is set to be greater than the proportion of the carrier included in the color pre-mixed toner, thereby making the quantity of the carrier included in the black pre-mixed toner greater than the quantity of the carrier included in the color pre-mixed toner, allowing delaying the degradation of the carrier included in the black pre-mixed toner, as well as allowing reducing the length of the interval between the replacement of the carrier for each respective color. As a consequence thereof, it is possible to extend the interval between the operation of the replacement of the developer. Accordingly, it is possible to adequately reduce both the increase in the occurrence of the down time that results from the operation of the replacement of the developer, as well as the increase in the running cost that results.

Although the preferred embodiments of the present invention have been described, it should be understood that the present invention is not limited to the embodiments, and various modifications and changes may be made to these embodiments.

What is claimed is:

1. A developer supplier for supplying a developer to a plurality of developing devices including a black developing device, and a color developing device, comprising:

a plurality of developer supplying units each configured to supply a developer in which a toner and a carrier are preliminarily dispersed at a given concentration to each of the plurality of developing devices, wherein the plurality of developer supplying units includes a black developer supplying unit configured to supply a black developer in which a black toner and carrier are preliminarily dispersed to the black developing device and a color developer supplying unit configured to supply a color developer in which a color toner other than black toner and carrier are preliminarily dispersed to the color developing device, a proportion of the carrier included in the black developer which is supplied to the black developing device is set so as to be greater than a proportion of the carrier included in the color developer which is supplied to the color developing device, the carrier included in the black developer which is supplied to the black developing device and the carrier included in the color developer which is supplied to the color developing device, consist of the same core material, and a substantially same amount of the developer is contained in the plurality of developing devices, and each developing device includes a developer discharge port to discharge a portion of the developer to an outside of the developing device, wherein a proportion of the carrier in the black developer supplied to the black developing device is substantially 20 wt %; and a proportion of the carrier in the color developer supplied to the color developing device is substantially 10 wt %.

2. An image forming apparatus, comprising:

the developer supplier according to claim 1;

a plurality of image carriers on each of which an electrostatic latent image is formed;

a plurality of developing devices each configured to develop the electrostatic latent image formed on each of the plurality of image carriers with the developer to form a toner image, the black developing device is configured to employ the black toner and the color developing device is configured to employ the color toner.

3. The developer supplier according to claim 1, further comprising;

a plurality of supplying containers each configured to store the developer, wherein each of the plurality of supplying containers is replaceably provided;

the plurality of supplying containers include a black toner supplying container configured to store the black toner, and a color toner supplying container configured to store the toner of the color other than black; and a proportion of the carrier included in the black toner supplying container is greater than a proportion of the carrier included in the color toner supplying container.

4. The developer supplier according to claim 1, wherein a particle of the carrier included the developer in each of the developer supplying units has substantially the same diameter.

5. The developer supplier according to claim 1, wherein a film of the carrier included in the developer in each of the developer supplying units has substantially the same thickness.

6. The developer supplier according to claim 1, wherein a film of the carrier included in the developer in each of the developer supplying units has the same material.

7. An image forming method, comprising:

charging each of a plurality of image carriers to form an electrostatic latent image;

supplying a developer to a plurality of developing devices including a black developing device and a color developing device, a black developer in which a toner and a carrier are preliminarily dispersed at a given concentration being supplied to the black developing device and a color developer in which a color toner and a carrier are preliminarily dispersed at a given concentration being supplied to the color developing device; and developing the electrostatic latent image formed on each of the plurality of image carriers with the developer to form a toner image, wherein a proportion of the carrier included in the black developer which is supplied to the black developing device is set so as to be greater than a proportion of the carrier included in the color developer which is supplied to the color developing device, and the carrier included in the black developer which is supplied to the black developing device and the carrier included in the color developer which is supplied to the color developing device, consist of the same core material, and a substantially same amount of the developer is contained in the plurality of developing devices, and each developing device includes a developer discharge port to discharge a portion of the developer to an outside of the developing device, wherein a proportion of the carrier in the black developer supplied to the black developing device is substantially 20 wt %; and a proportion of the carrier in the color developer supplied to the color developing device is substantially 10 wt %.

8. The image forming method according to claim 7, wherein the black developing device is configured to employ the black toner and the color developing device is the color developing device configured to employ the color toner.

9. The image forming method according to claim 7, further comprising;

preparing a plurality of supplying containers each configured to store the developer, wherein each of the plurality of supplying containers is replaceably provided;

the plurality of supplying containers include a black toner supplying container configured to store the black toner, and a color toner supplying container configured to store the toner of the color other than black; and a proportion of the carrier included in the black toner supplying container is greater than a proportion of the carrier included in the color toner supplying container.

10. The image forming method according to claim 7, wherein a particle of the carrier included in the developer in each of the developer supplying units has substantially the same diameter.

11. The image forming method according to claim 7, wherein a film of the carrier included in the developer in each of the developer supplying units has substantially the same thickness.

12. The image forming method according to claim 7, wherein a film of the carrier included in the developer in each of the developer supplying units has the same material.

13. A developer supplier for supplying a developer to a plurality of developing devices including a black developing device, and a color developing device, comprising:

a plurality of developer supplying units each configured to supply a developer in which a toner and a carrier are preliminarily dispersed at a given concentration to each of the plurality of developing devices, wherein the plurality of developer supplying units includes a black developer supplying unit configured to supply a black developer in which a black toner and carrier are preliminarily dispersed to the black developing device and a color developer supplying unit configured to supply a color developer in which a color toner other than black toner and carrier are preliminarily dispersed to the color developing device, a proportion of the carrier included in the black developer which is supplied to the black developing device is set so as to be greater than a proportion of the carrier included in the color developer which is supplied to the color developing device, the carrier included in each color developer supplying unit has a different proportion, the carrier included in the developer in each of the developer supplying units consist of the same core material, and a substantially same amount of the developer is contained in the plurality of developing devices, and each developing device includes a developer discharge port to discharge a portion of the developer to an outside of the developing device, wherein a proportion of the carrier in the black developer supplied to the black developing device is substantially 20 wt %; and a proportion of the carrier in the color developer supplied to the color developing device is substantially 10 wt %.

14. An image forming apparatus, comprising:

the developer supplier according to claim 13;

a plurality of image carriers on each of which an electrostatic latent image is formed;

a plurality of developing devices each configured to develop the electrostatic latent image formed on each of the plurality of image carriers with the developer to form a toner image, the black developing device is configured to employ the black toner and the color developing device is configured to employ the color toner.

15. The developer supplier according to claim 13, further comprising;

a plurality of supplying containers each configured to store the developer, wherein each of the plurality of supplying containers is replaceably provided;

the plurality of supplying containers include a black toner supplying container configured to store the black toner, and a color toner supplying container configured to store the toner of the color other than black; and a proportion of the carrier included in the black toner supplying container is greater than a proportion of the carrier included in the color toner supplying container.

16. The developer supplier according to claim 13, wherein a particle of the carrier included in the developer in each of the developer supplying units has substantially the same diameter.

17. The developer supplier according to claim 13, wherein a film of the carrier included in the developer in each of the developer supplying units has substantially the same thickness.

18. The developer supplier according to claim 13, wherein a film of the carrier included in the developer in each of the developer supplying units has the same material.

19. An image forming method, comprising:

charging each of a plurality of image carriers to form an electrostatic latent image;

supplying a developer to a plurality of developing devices including a black developing device and a color developing device, a black developer in which a toner and a carrier are preliminarily dispersed at a given concentration being supplied to the black developing device and a color developer in which a color toner and a carrier are preliminarily dispersed at a given concentration being supplied to the color developing device; and developing the electrostatic latent image formed on each of the plurality of image carriers with the developer to form a toner image, wherein a proportion of the carrier included in the black developer which is supplied to the black developing device is set so as to be greater than a proportion of the carrier included in the color developer which is supplied to the color developing device, the carrier included in each color developer supplying unit has a different proportion, the carrier included in the developer in each of the developer supplying units consist of the same core material, and a substantially same amount of the developer is contained in the plurality of developing devices, and each developing device includes a developer discharge port to discharge a portion of the developer to an outside of the developing device, wherein a proportion of the carrier in the black developer supplied to the black developing device is substantially 20 wt %; and a proportion of the carrier in the color developer supplied to the color developing device is substantially 10wt %.

20. The image forming method according to claim 19, wherein the black developing device is configured to employ the black toner and the color developing device is the color developing device configured to employ the color toner.

21. The image forming method according to claim 19, further comprising;

preparing a plurality of supplying containers each configured to store the developer, wherein each of the plurality of supplying containers is replaceably provided;

the plurality of supplying containers include a black toner supplying container configured to store the black toner, and a color toner supplying container configured to store the toner of the color other than black; and a proportion of the carrier included in the black toner supplying container is greater than a proportion of the carrier included in the color toner supplying container.

22. The image forming method according to claim 19, wherein a particle of the carrier included in the developer in each of the developer supplying units has substantially the same diameter.

23. The image forming method according to claim 19, wherein a film of the carrier included in the developer in each of the developer supplying units has substantially the same thickness.

24. The image forming method according to claim 19, wherein a film of the carrier included in the developer in each of the developer supplying units has the same material.

25. A developer supplier for supplying a developer to a plurality of developing devices including a black developing device, and a color developing device, comprising:

a plurality of developer supplying units each configured to supply a developer in which a toner and a carrier are preliminarily dispersed at a given concentration to each of the plurality of developing devices, wherein the plurality of developer supplying units includes a black developer supplying unit configured to supply a black developer in which a black toner and carrier are preliminarily dispersed to the black developing device and a color developer supplying unit configured to supply a color developer in which a color toner other than black toner and carrier are preliminarily dispersed to the color developing device, a proportion of the carrier included in the black developer which is supplied to the black developing device is set so as to be greater than a proportion of the carrier included in the color developer which is supplied to the color developing device, the carrier included in the black developer which is supplied to the black developing device and the carrier included in the color developer which is supplied to the color developing device, consist of the same core material, and a substantially same amount of the developer is contained in the plurality of developing devices and each developing device includes a developer discharge port to discharge a portion of the developer to an outside of the developing device, wherein a proportion of the carrier in the black developer supplied to the black developing device is substantially two times a proportion of the carrier in the color developer supplied to the color developing device.

26. An image forming method, comprising:

charging each of a plurality of image carriers to form an electrostatic latent image;

supplying a developer to a plurality of developing devices including a black developing device and a color developing device, a black developer in which a toner and a carrier are preliminarily dispersed at a given concentration being supplied to the black developing device and a color developer in which a color toner and a carrier are preliminarily dispersed at a given concentration being supplied to the color developing device; and developing the electrostatic latent image formed on each of the plurality of image carriers with the developer to form a toner image, wherein a proportion of the carrier included in the black developer which is supplied to the black developing device is set so as to be greater than a proportion of the carrier included in the color developer which is supplied to the color developing device, and the carrier included in the black developer which is supplied to the black developing device and the carrier included in the color developer which is supplied to the color developing device, consist of the same core material, and a substantially same amount of the developer is contained in the plurality of developing devices, and each developing device includes a developer discharge port to discharge a portion of the developer to an outside of the developing device, wherein a proportion of the carrier in the black developer supplied to the black developing device is substantially two times a proportion of the carrier in the color developer supplied to the color developing device.

27. A developer supplier for supplying a developer to a plurality of developing devices including a black developing device, and a color developing device, comprising:

a plurality of developer supplying units each configured to supply a developer in which a toner and a carrier are preliminarily dispersed at a given concentration to each of the plurality, of developing devices, wherein the plurality of developer supplying units includes a black developer supplying unit configured to supply a black developer in which a black toner and carrier are preliminarily dispersed to the black developing device and a color developer supplying unit configured to supply a color developer in which a color toner other than black toner and carrier are preliminarily dispersed to the color developing device, a proportion of the carrier included in the black developer which is supplied to the black developing device is set so as to be greater than a proportion of the carrier included in the color developer which is supplied to the color developing device, the carrier included in each color developer supplying unit has a different proportion, the carrier included in the developer in each of the developer supplying units consist of the same core material, and a substantially same amount of the developer is contained in the plurality of developing devices, and each developing device includes a developer discharge port to discharge a portion of the developer to an outside of the developing device, wherein a proportion of the carrier in the black developer supplied to the black developing device is substantially two times a proportion of the carrier in the color developer supplied to the color developing device.

* * * * *